US007339531B2

(12) United States Patent
Desclos et al.

(10) Patent No.: US 7,339,531 B2
(45) Date of Patent: Mar. 4, 2008

(54) MULTI FREQUENCY MAGNETIC DIPOLE ANTENNA STRUCTURES AND METHOD OF REUSING THE VOLUME OF AN ANTENNA

(75) Inventors: Laurent Desclos, San Diego, CA (US); Gregory Poilasne, San Diego, CA (US); Jeff Shamblin, San Marcos, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 249 days.

(21) Appl. No.: 10/756,884

(22) Filed: Jan. 14, 2004

(65) Prior Publication Data

US 2004/0233111 A1 Nov. 25, 2004

Related U.S. Application Data

(63) Continuation-in-part of application No. 10/253,016, filed on Sep. 23, 2002, now Pat. No. 7,012,568, which is a continuation of application No. 09/892,928, filed on Jun. 26, 2001, now Pat. No. 6,456,243.

(51) Int. Cl.
*H01Q 1/24* (2006.01)

(52) U.S. Cl. ..... 343/702; 343/700 MS

(58) Field of Classification Search ..... 343/702, 343/700 MS, 846, 895, 741, 866
See application file for complete search history.

(56) References Cited

U.S. PATENT DOCUMENTS

| | | | | |
|---|---|---|---|---|
| 4,367,475 | A * | 1/1983 | Schiavone | 343/767 |
| 5,184,144 | A * | 2/1993 | Thombs | 343/781 R |
| 5,337,065 | A * | 8/1994 | Bonnet et al. | 343/767 |
| 5,626,666 | A * | 5/1997 | Briat et al. | 106/728 |
| 5,677,698 | A * | 10/1997 | Snowdon | 343/770 |
| 5,754,143 | A * | 5/1998 | Warnagiris et al. | 343/767 |
| 5,790,080 | A * | 8/1998 | Apostolos | 343/744 |
| 5,903,240 | A | 5/1999 | Kawahata et al. | |
| 5,936,590 | A * | 8/1999 | Funder | 343/795 |
| 5,943,020 | A * | 8/1999 | Liebendoerfer et al. | 343/702 |
| 6,011,519 | A | 1/2000 | Sadler et al. | |
| 6,034,638 | A | 3/2000 | Thiel et al. | |
| 6,307,520 | B1 * | 10/2001 | Liu | 343/767 |
| 6,339,400 | B1 * | 1/2002 | Flint et al. | 343/702 |
| 6,456,243 | B1 | 9/2002 | Poilasne et al. | |
| 6,774,850 | B2 * | 8/2004 | Chen | 343/700 MS |
| 7,081,854 | B2 * | 7/2006 | Ying et al. | 343/702 |
| 2002/0190905 | A1 * | 12/2002 | Flint et al. | 343/702 |

FOREIGN PATENT DOCUMENTS

| | | |
|---|---|---|
| CN | 1296649 A | 5/2001 |
| EP | 0604338 | 6/1994 |

(Continued)

*Primary Examiner*—Huedung Mancuso
(74) *Attorney, Agent, or Firm*—Foley and Lardner LLP

(57) ABSTRACT

Various resonant modes of a multiresonant antenna structure share at least portions of the structure volume. The basic antenna element has a substantially planar structure with a planar conductor and a pair of parallel elongated conductors, each having a first end electrically connected to the planar conductor. Additional elements may be coupled to the basic element in an array. In this way, individual antenna structures share common elements and volumes, thereby increasing the ratio of relative bandwidth to volume.

17 Claims, 24 Drawing Sheets

FOREIGN PATENT DOCUMENTS

| | | |
|---|---|---|
| EP | 0757405 | 2/1997 |
| EP | 0942488 | 9/1999 |
| JP | 5601202 | 2/1981 |
| JP | 2000 68736 | 3/2000 |
| WO | WO 1999/043045 | 8/1999 |
| WO | WO 2001/020714 | 3/2001 |
| WO | WO 03/092118 | 11/2003 |

* cited by examiner

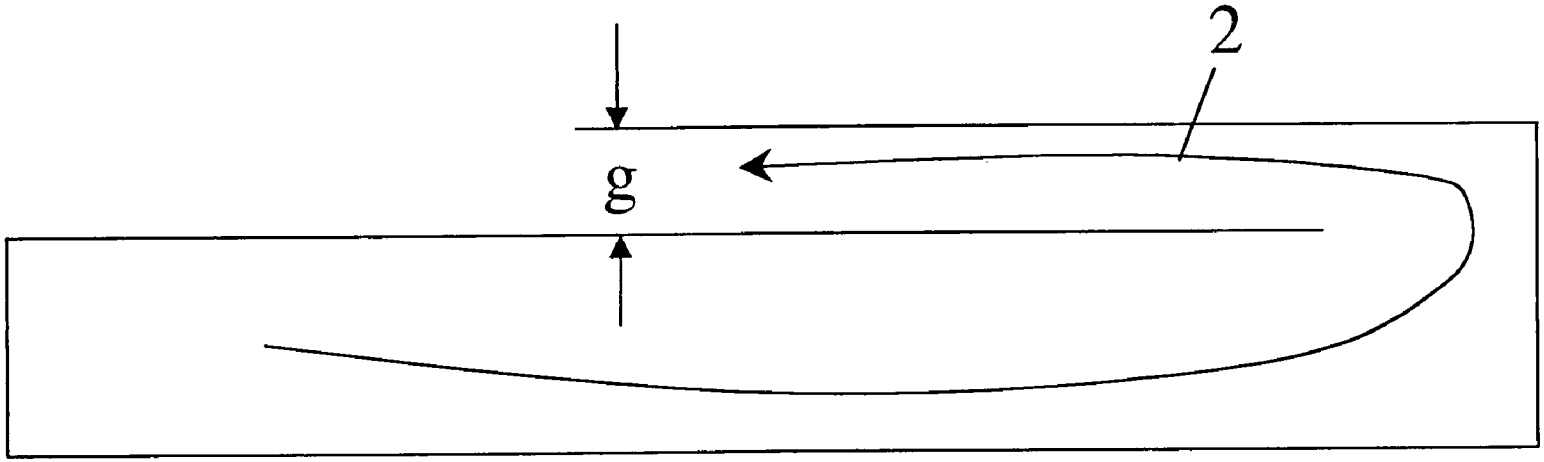
-Fig. 5-
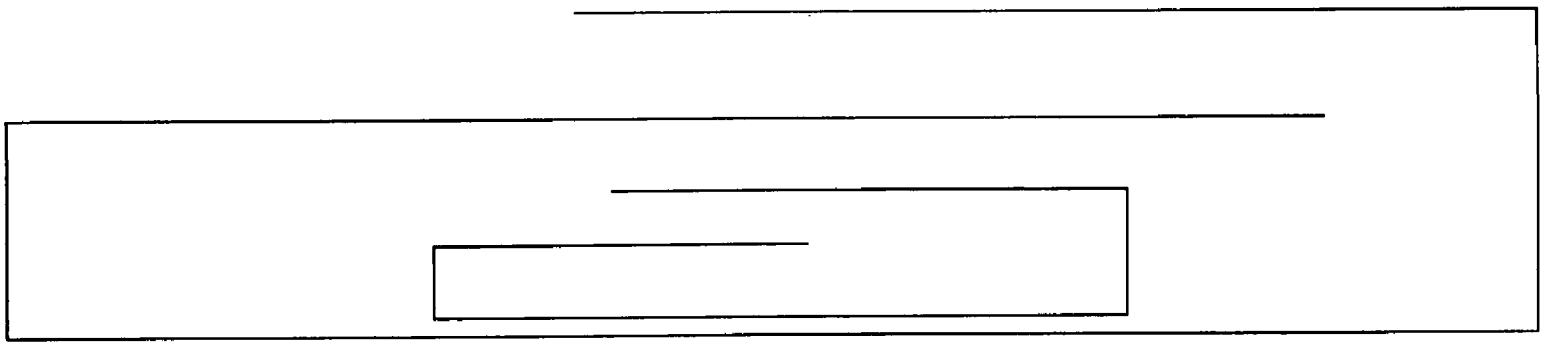
-Fig. 6-

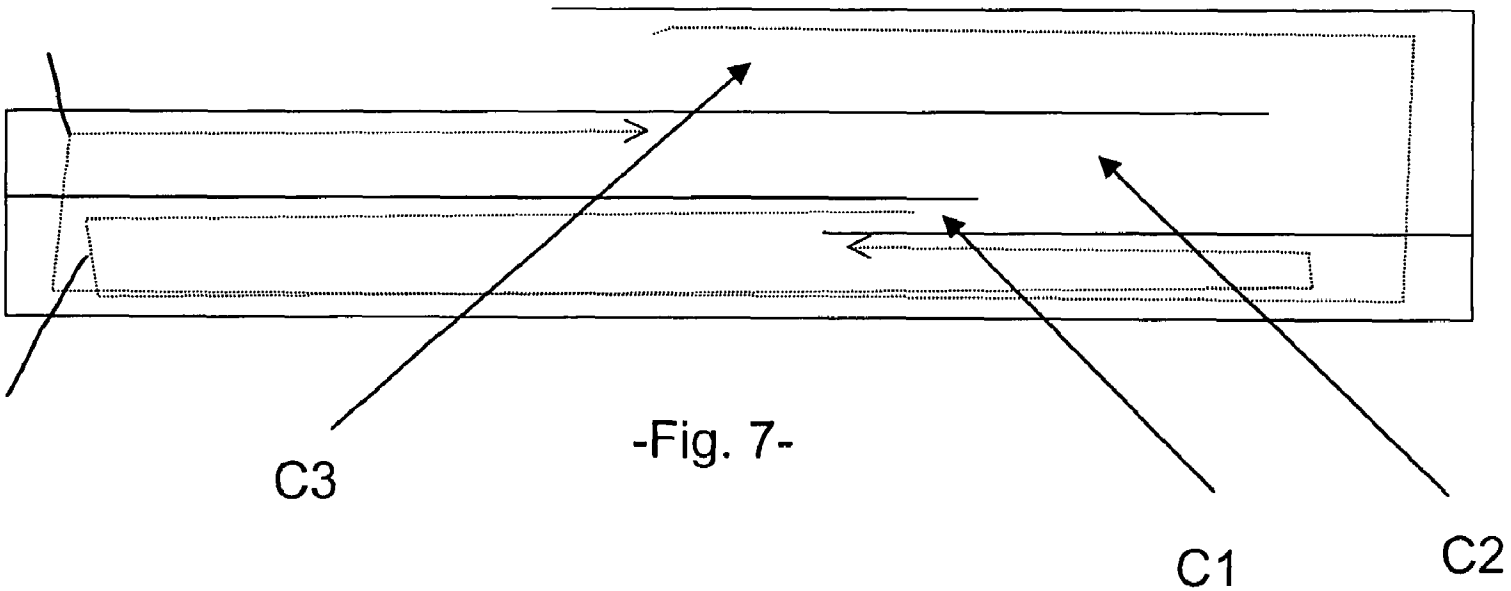
-Fig. 7-

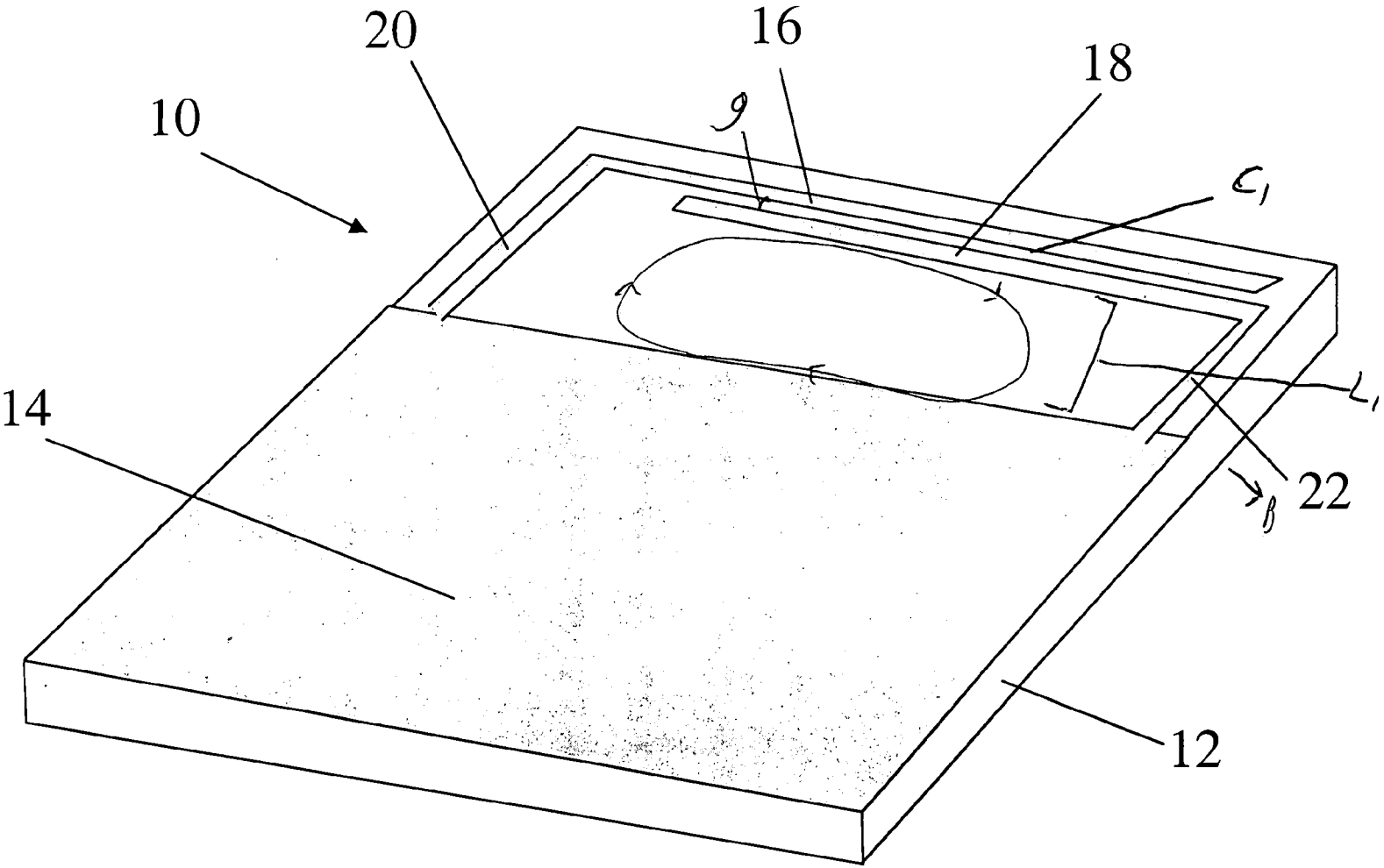
-Fig. 8-

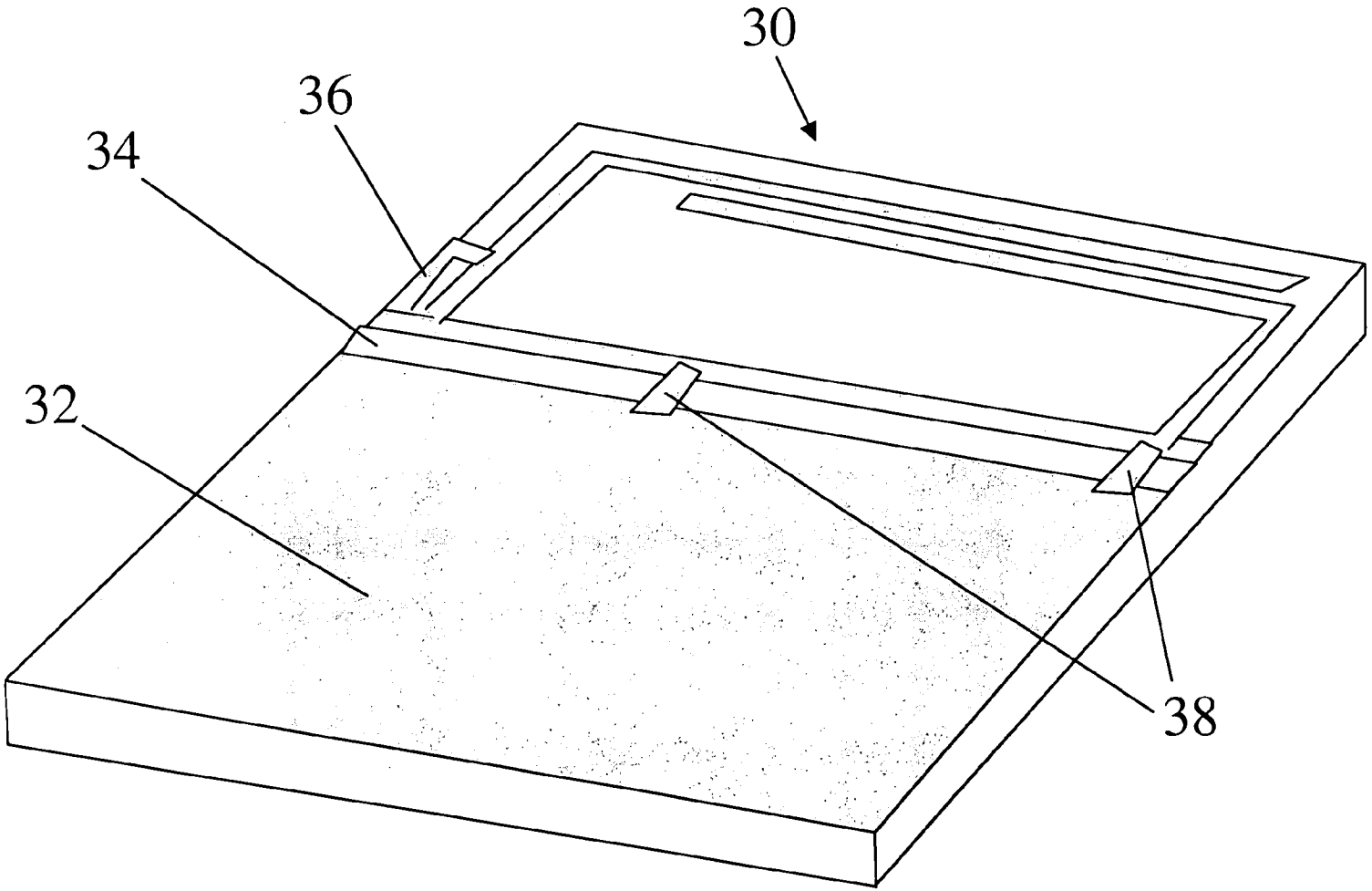
-Fig. 9-

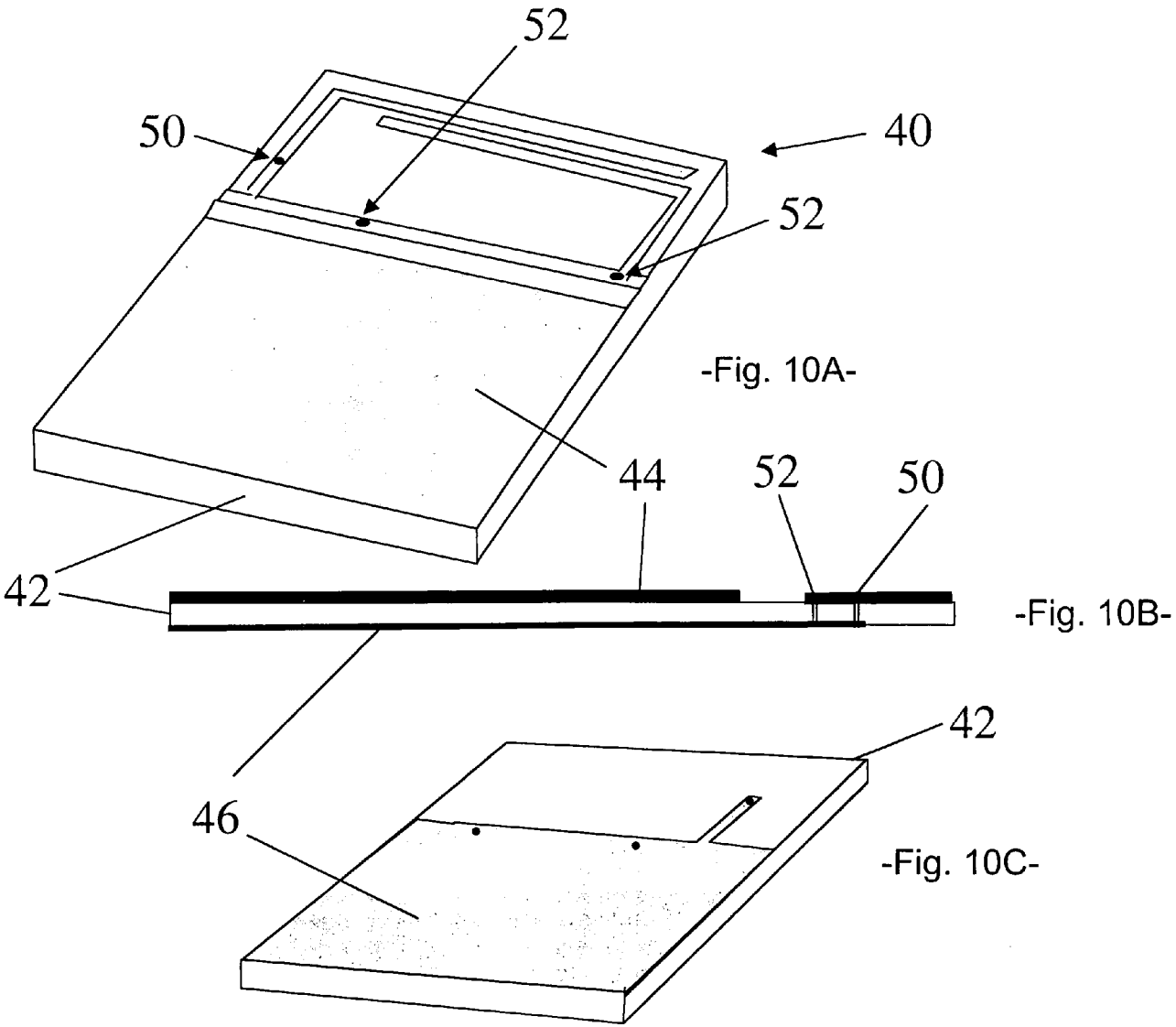
40
52
52
50
-Fig. 10A-
44
42
50
52
-Fig. 10B-
46
42
-Fig. 10C-

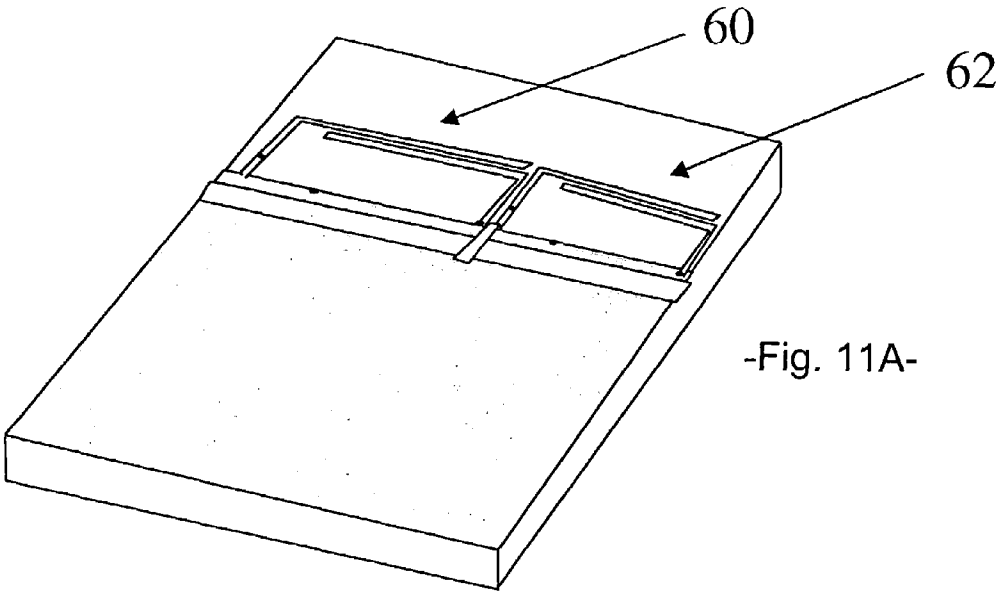
-Fig. 11A-
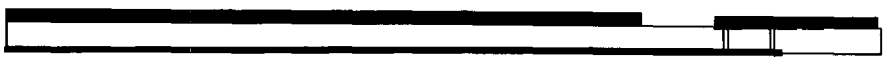
-Fig. 11B-
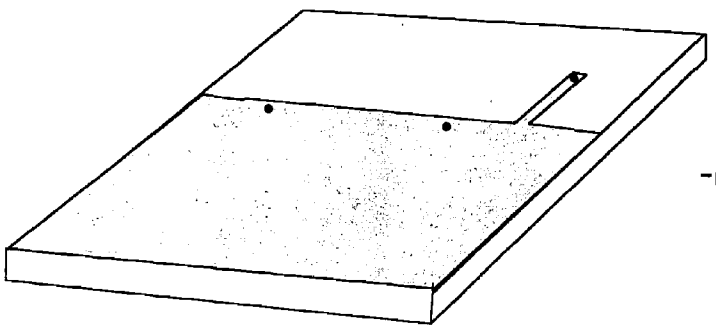
-Fig. 11C-

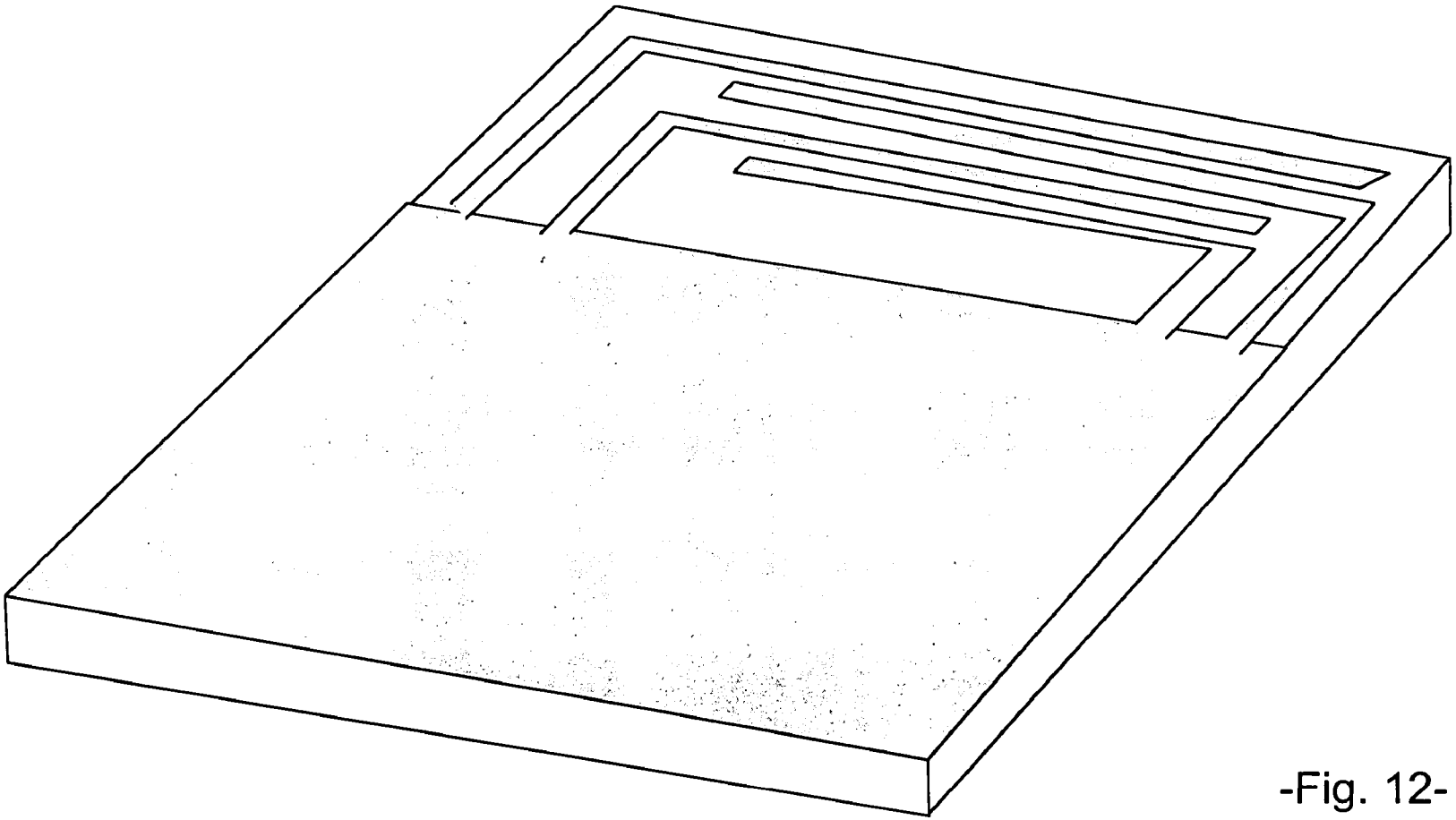
-Fig. 12-

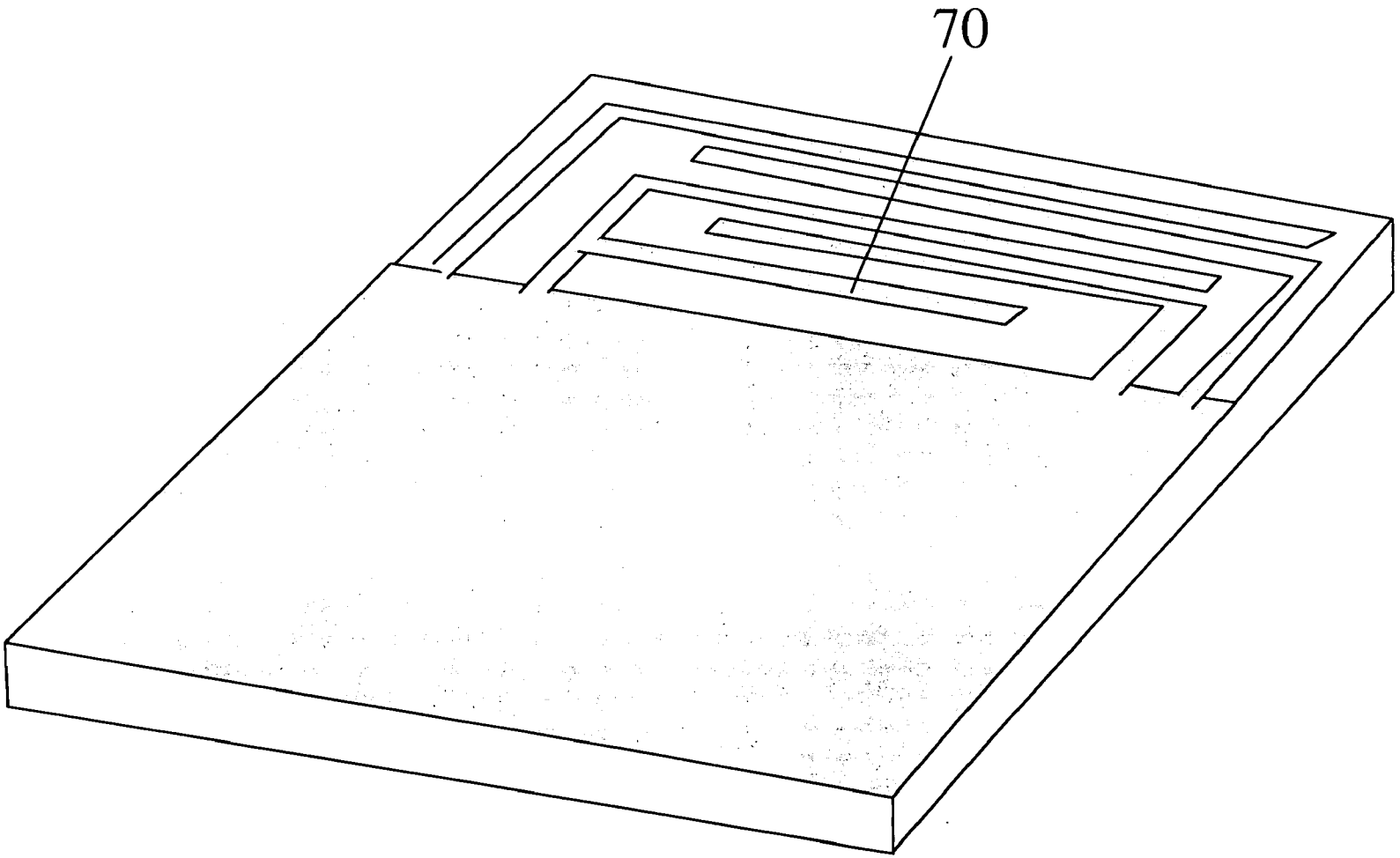
-Fig.13-

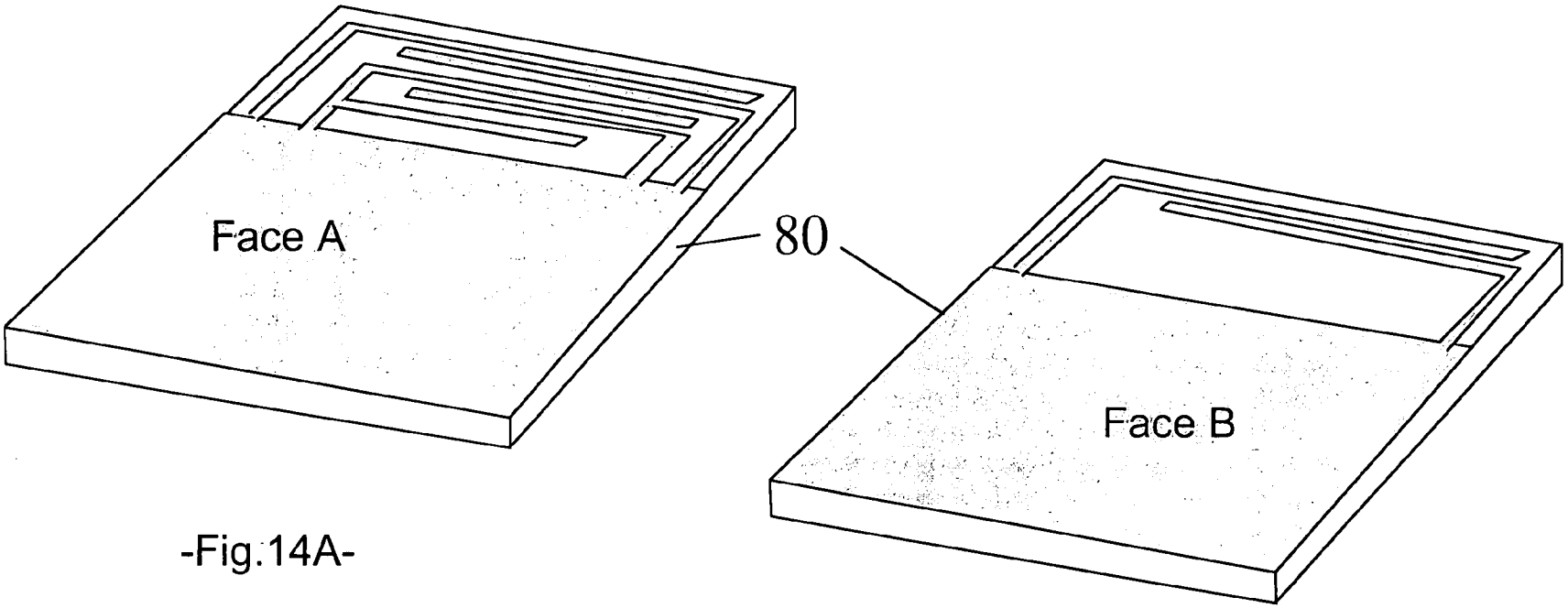
-Fig.14B-
-Fig.14A-

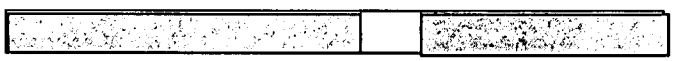
-Fig. 15B-
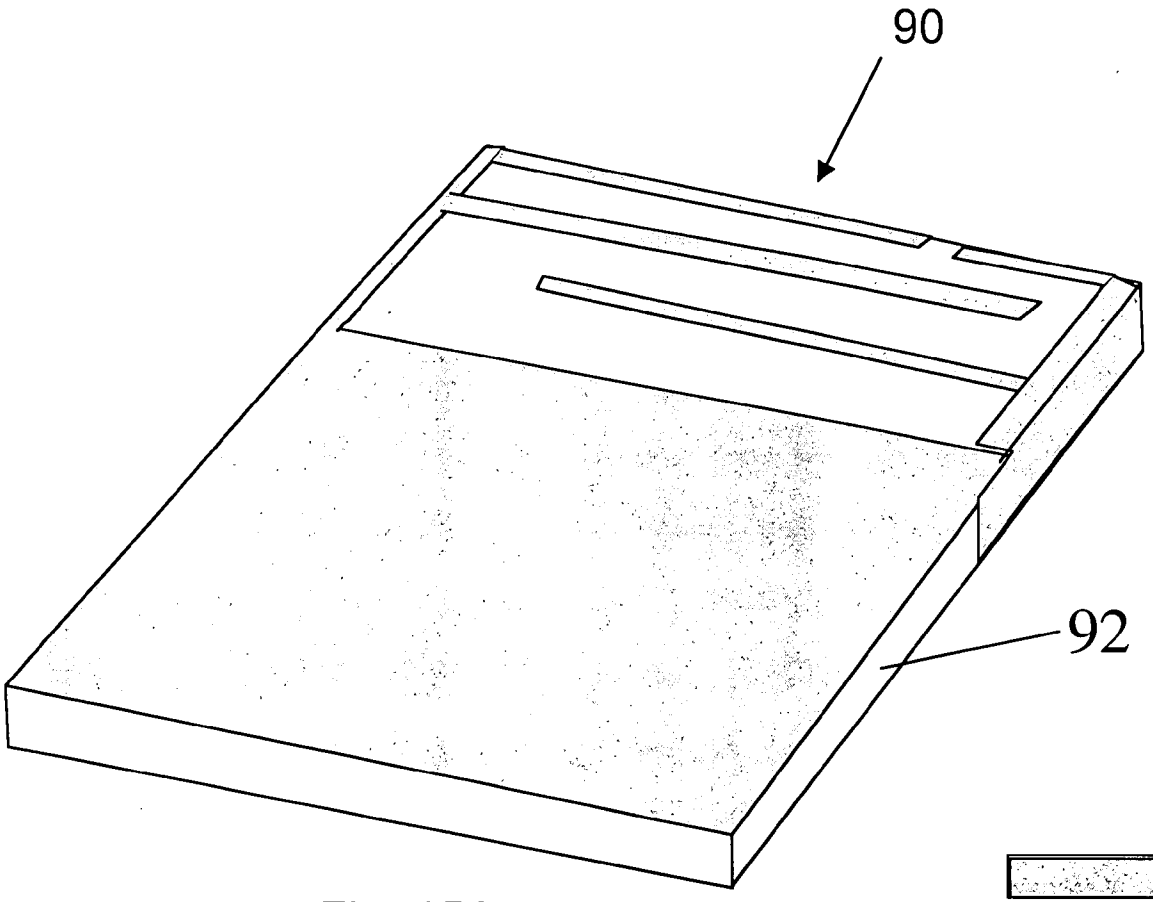
-Fig. 15A-

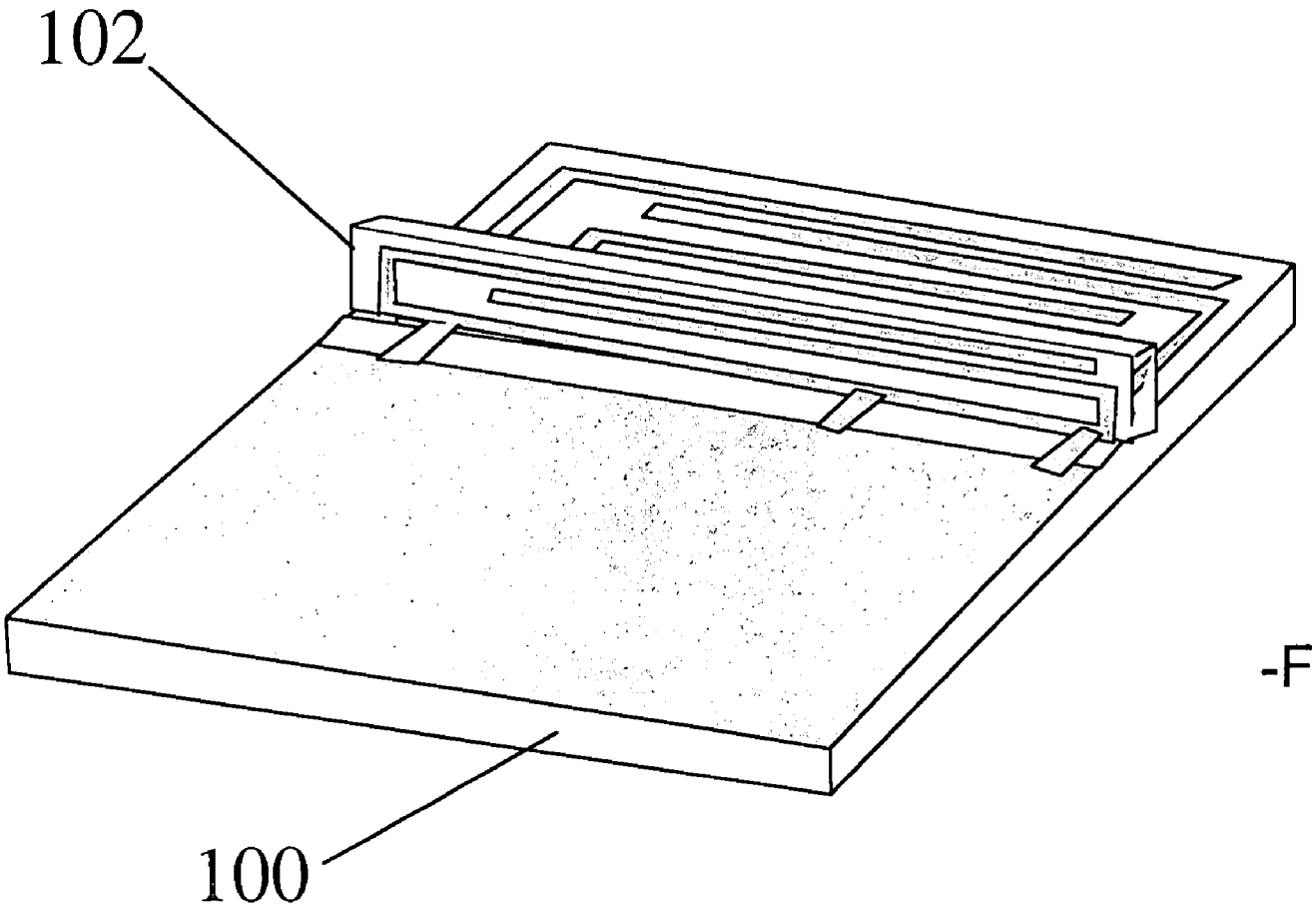
-Fig. 16A-

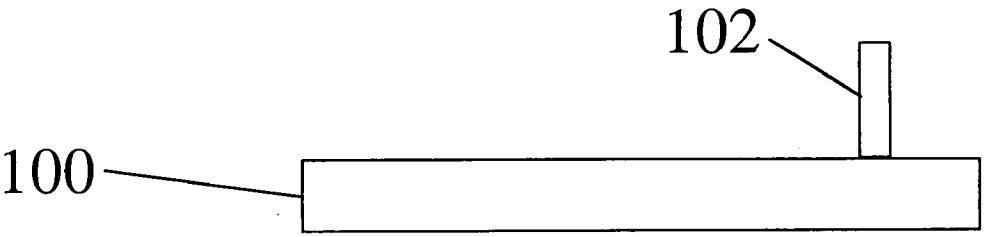
-Fig. 16B-
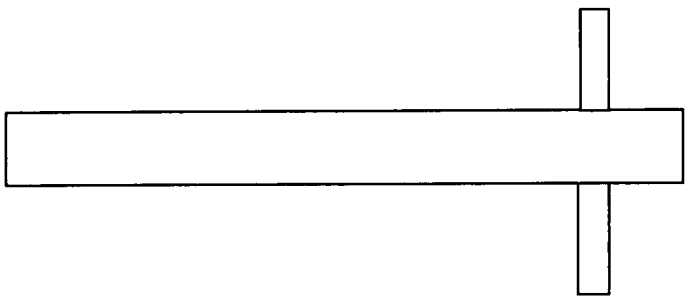
-Fig. 17A-
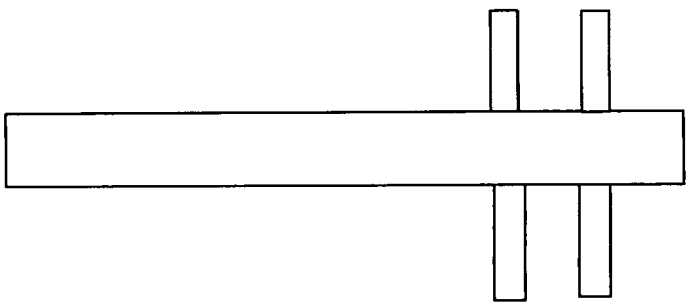
-Fig. 17B-

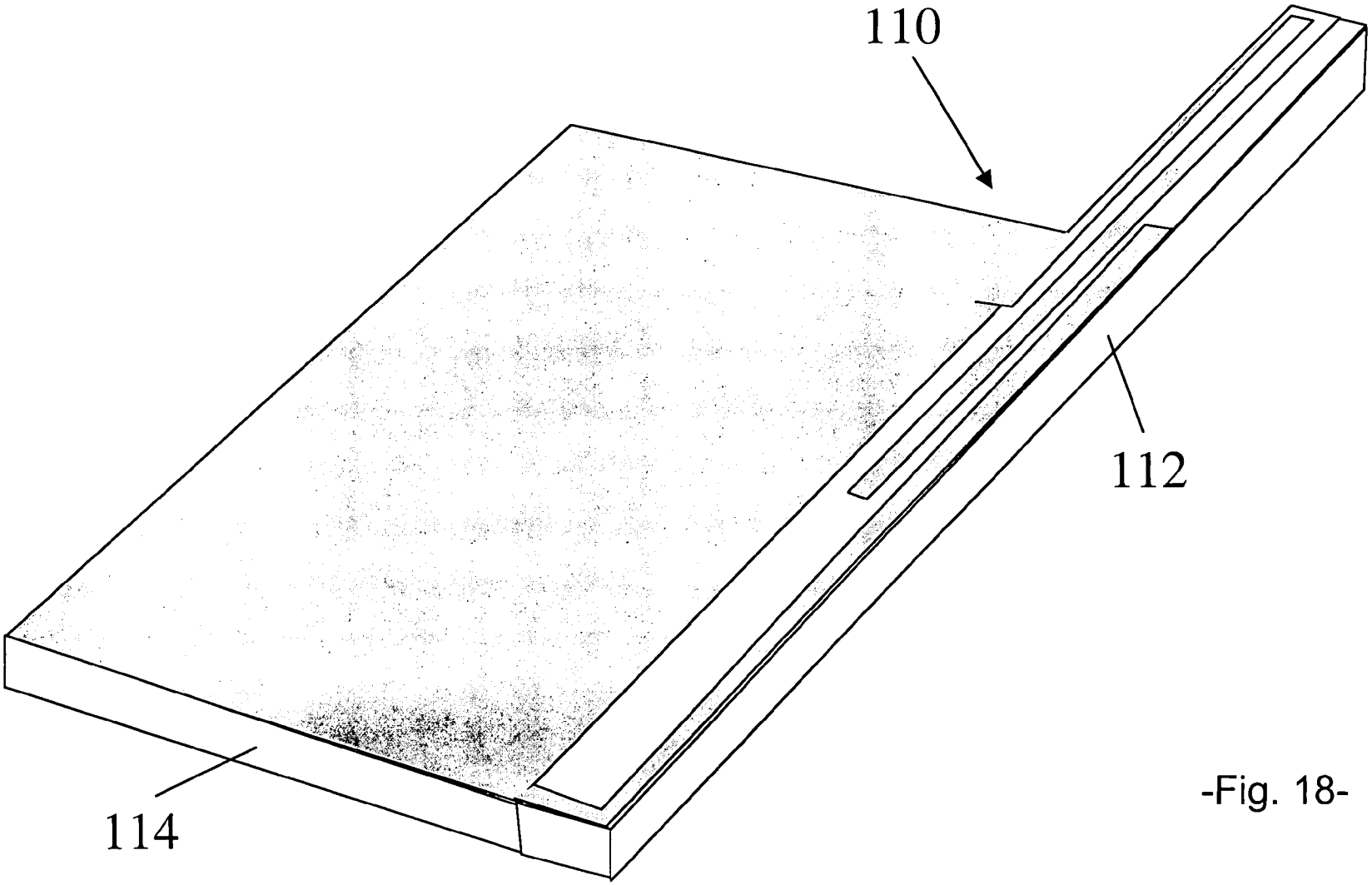
-Fig. 18-

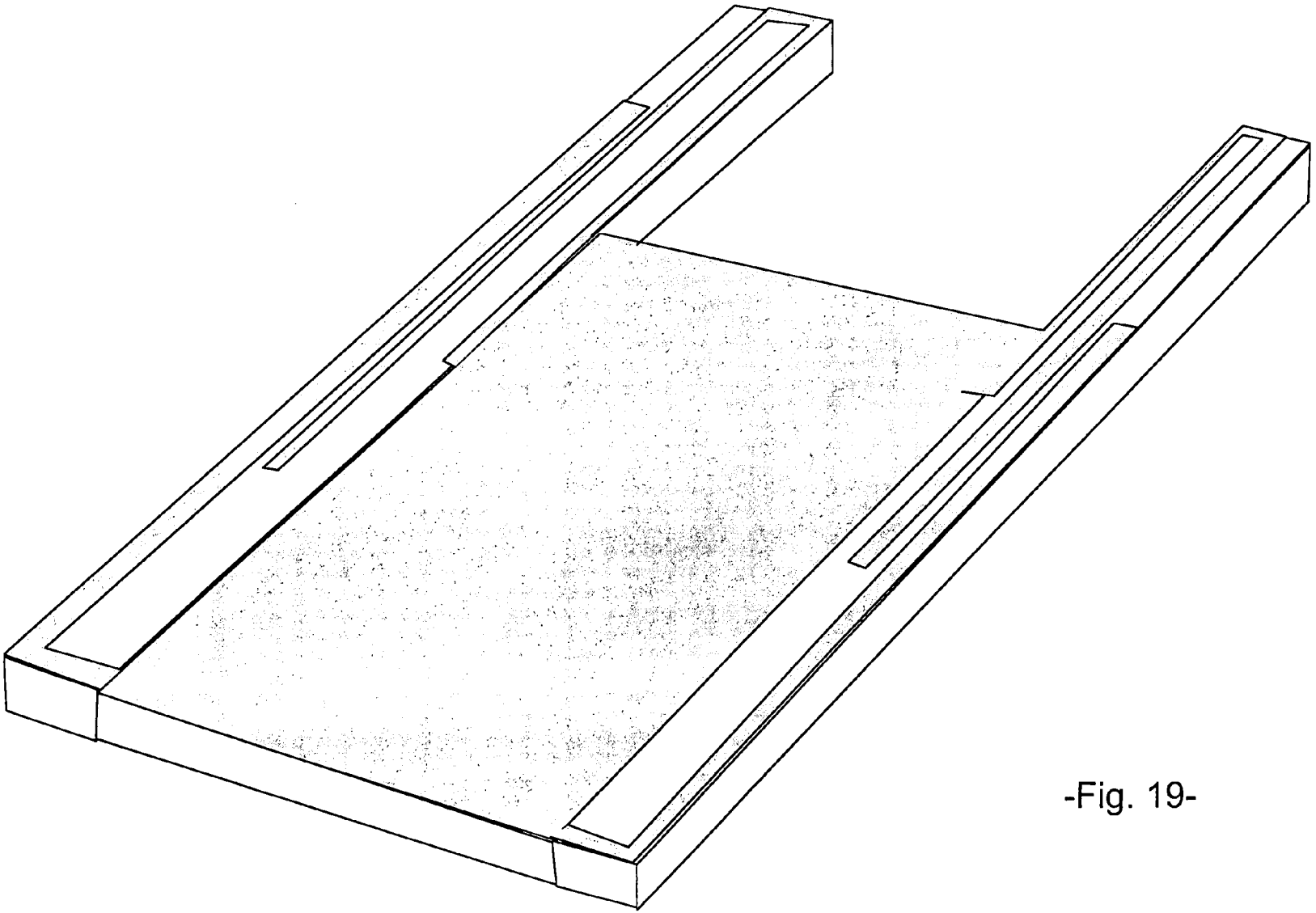
-Fig. 19-

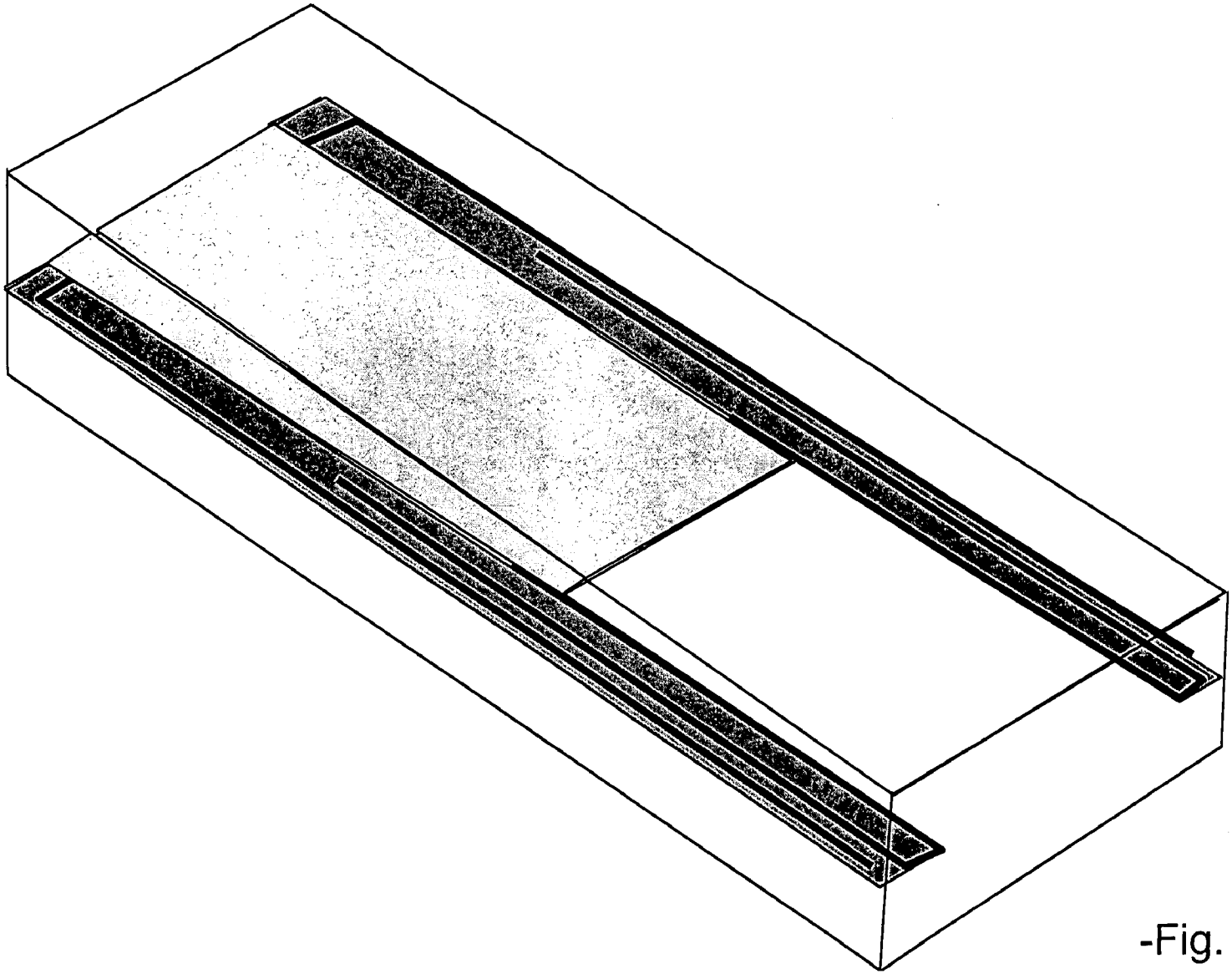
-Fig. 20-

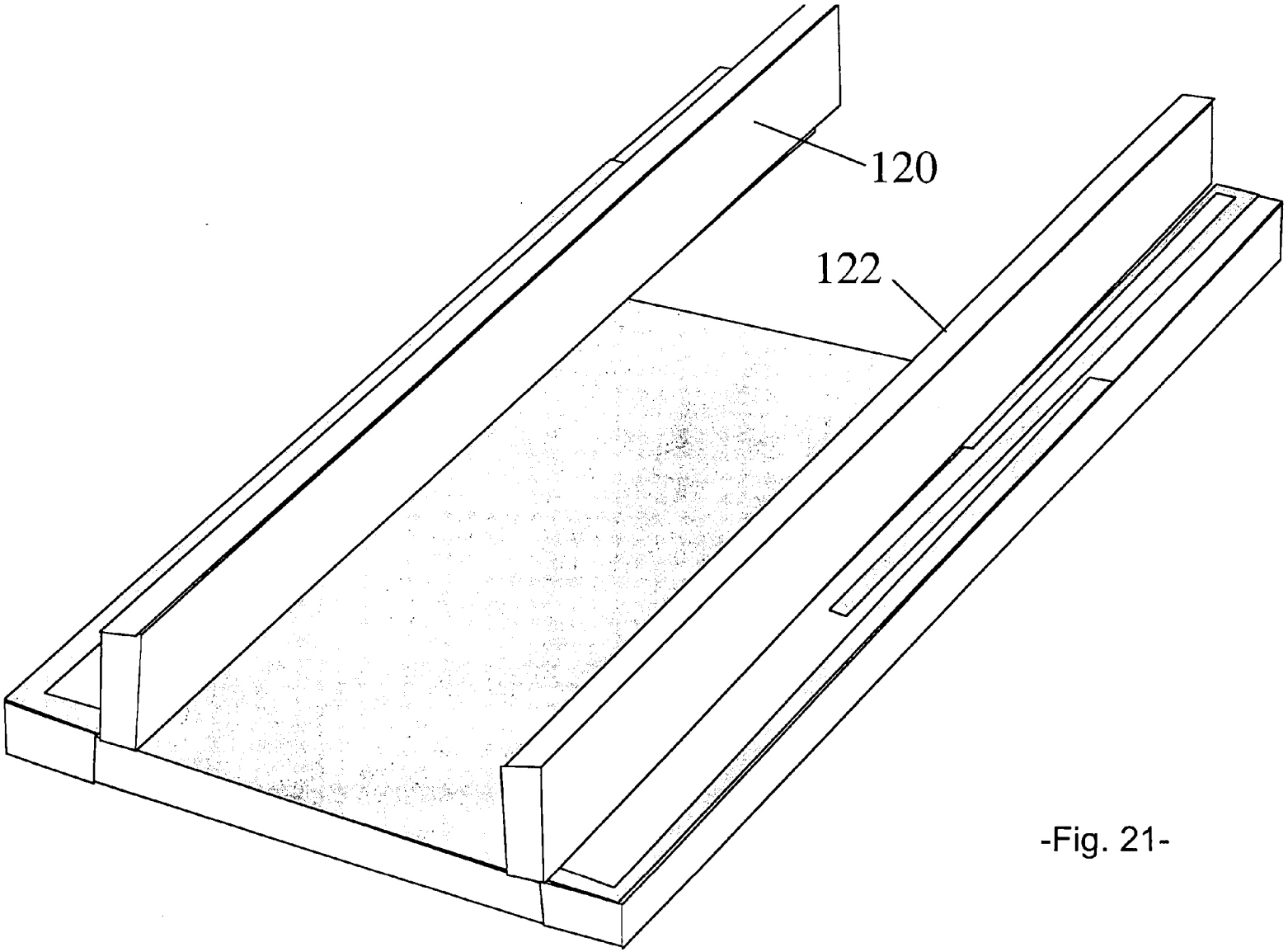
-Fig. 21-

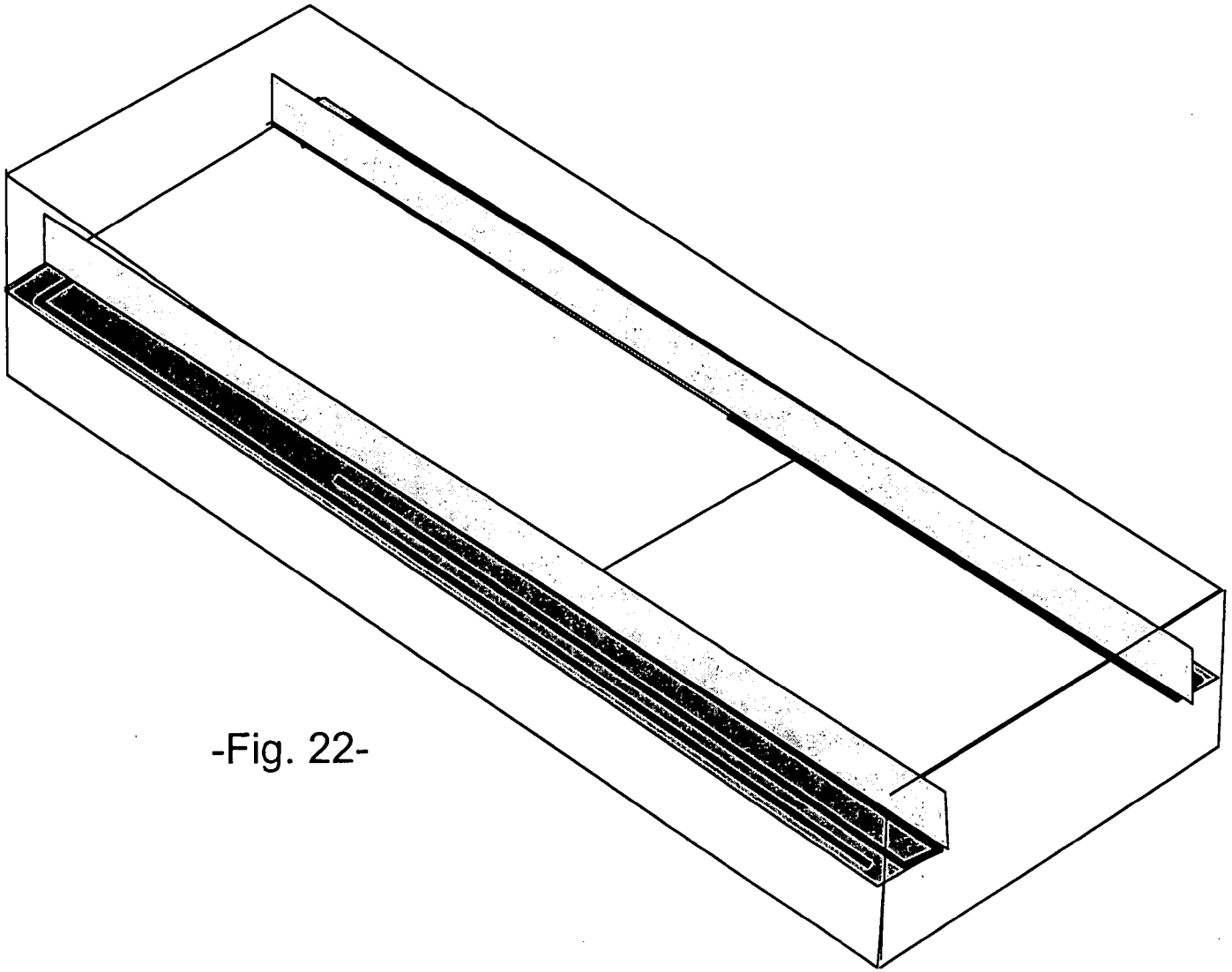
-Fig. 22-

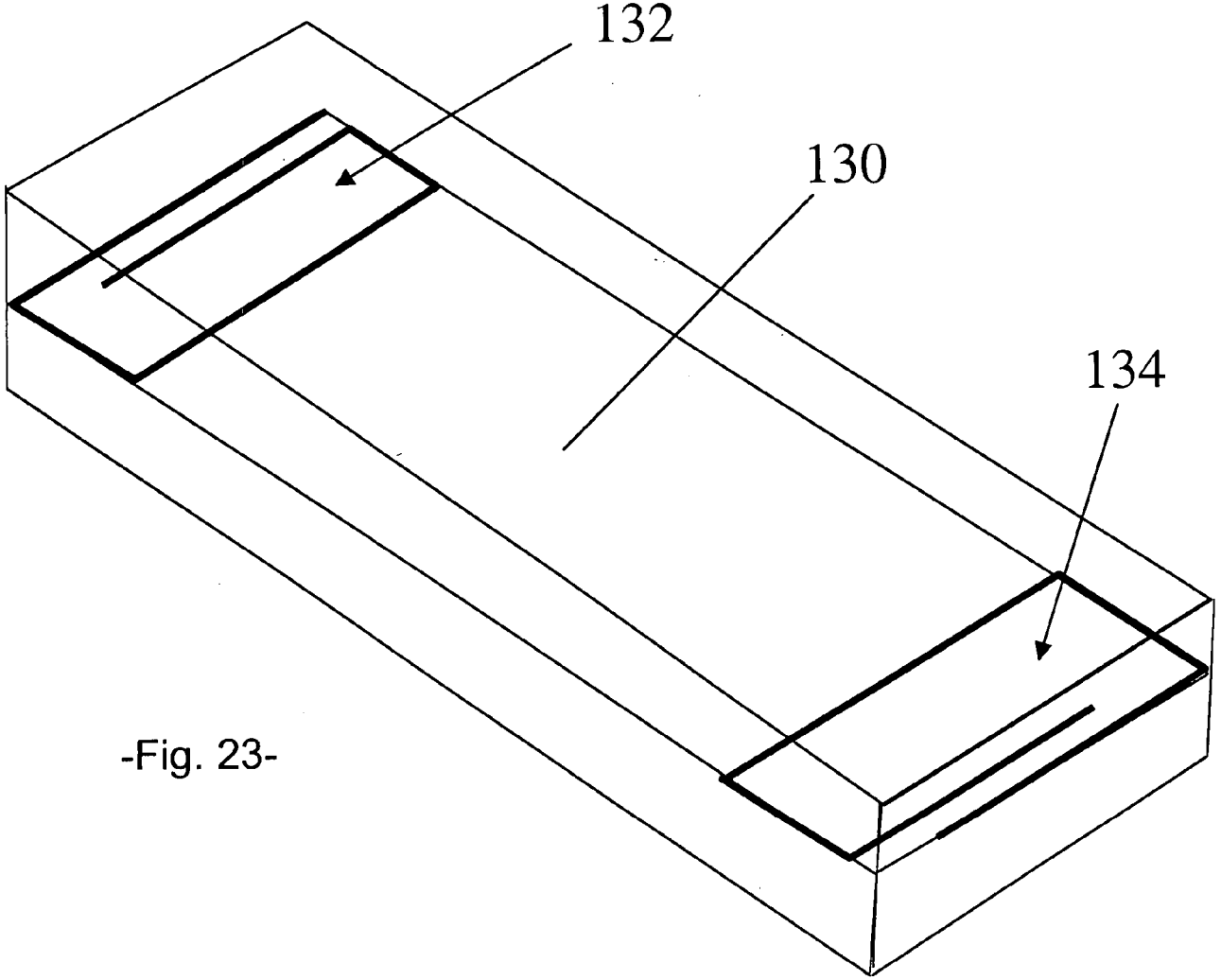
-Fig. 23-

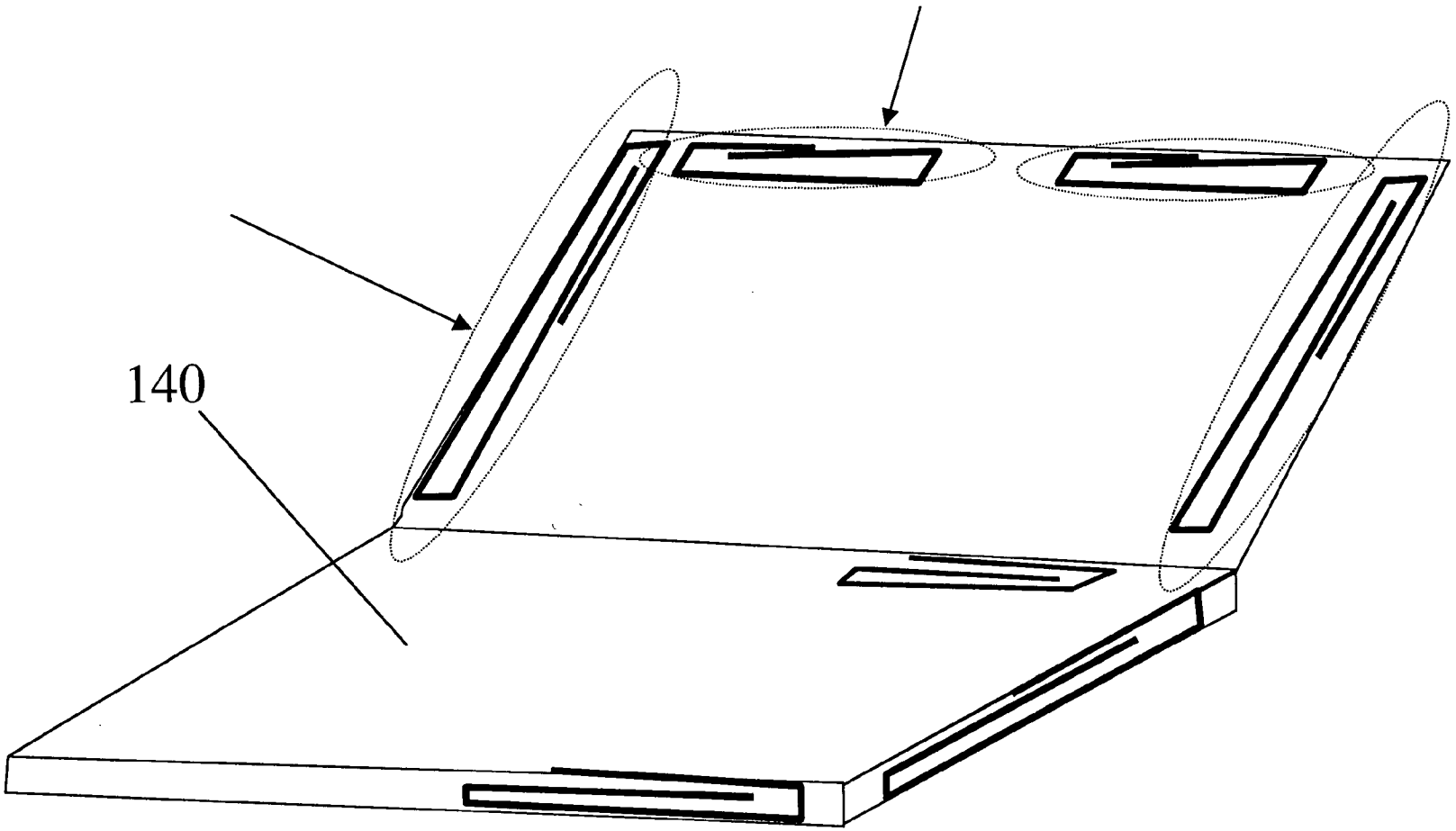
-Fig. 24-

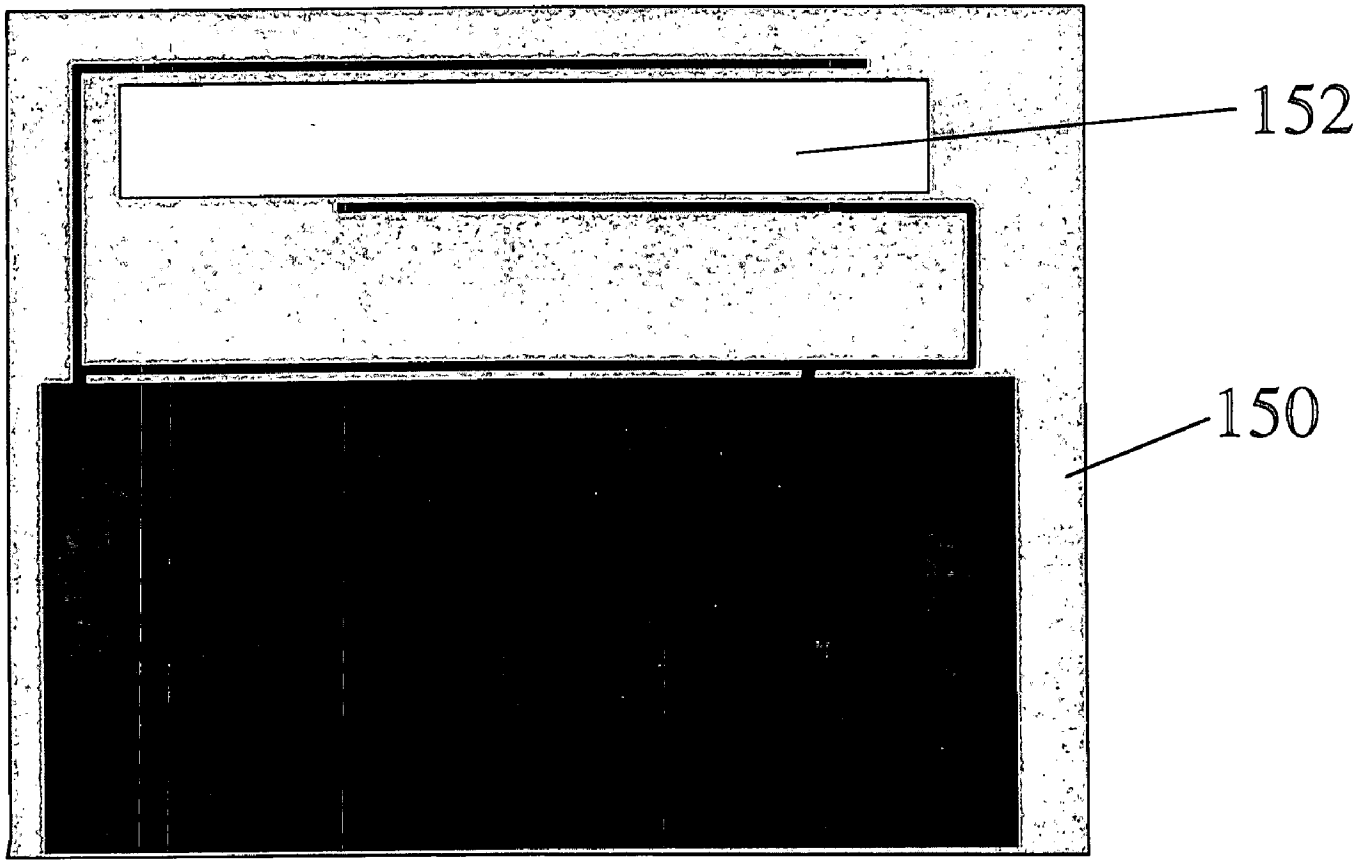
-Fig. 25-

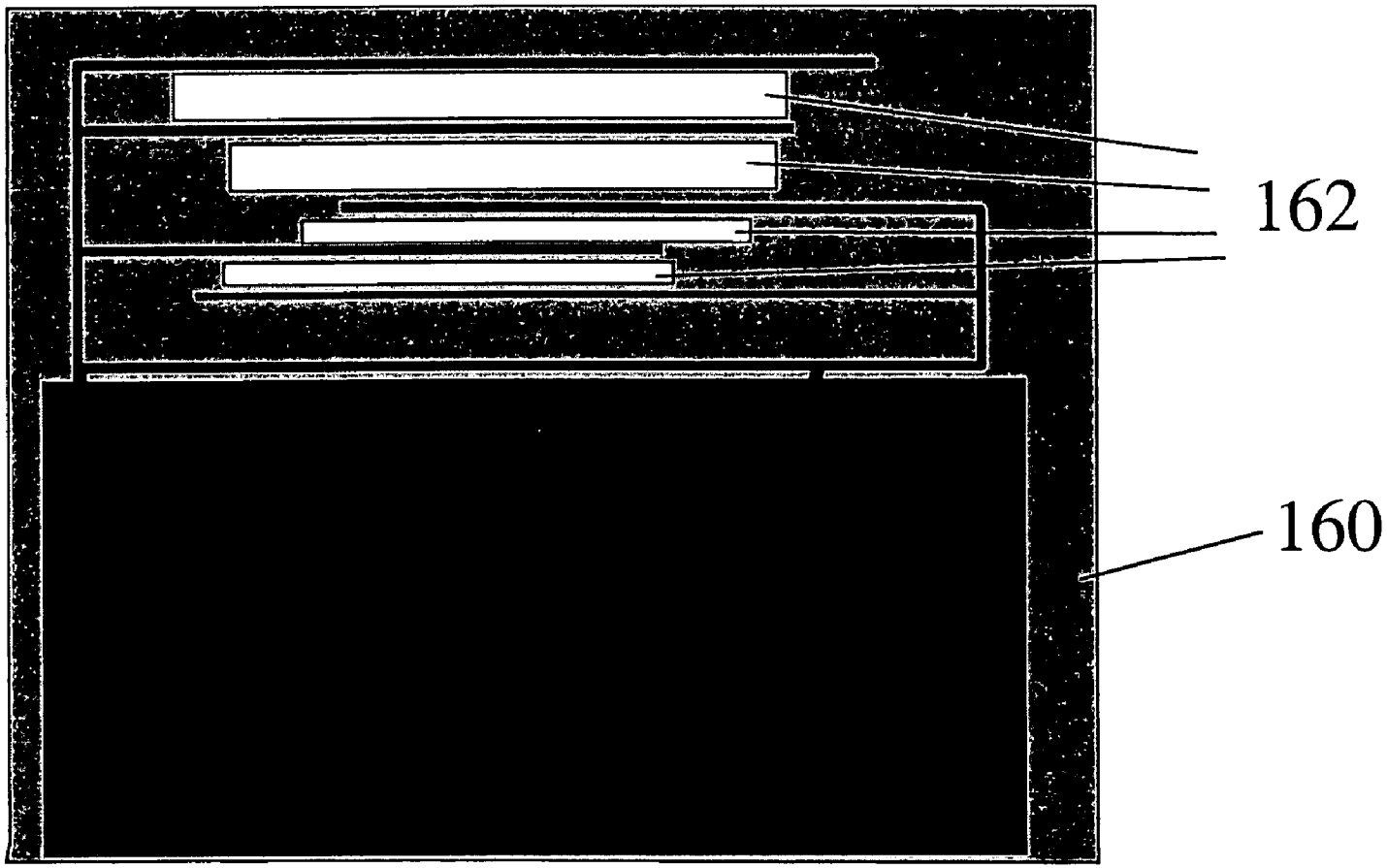
-Fig. 26-

MULTI FREQUENCY MAGNETIC DIPOLE ANTENNA STRUCTURES AND METHOD OF REUSING THE VOLUME OF AN ANTENNA

CROSS REFERENCE TO RELATED APPLICATIONS

This application is a continuation-in-part of application Ser. No. 10/253,016 filed Sep. 23, 2002 now U.S. Pat. No. 7,012,568, which is a continuation of application Ser. No. 09/892,928 filed Jun. 26, 2001, now U.S. Pat. No. 6,456,243, the disclosure of which is incorporated herein by reference.

This application relates to U.S. Pat. No. 6,323,810, titled "Multimode Grounded Finger Patch Antenna" by Gregory Poilasne et al., owned by the assignee of this application and incorporated herein by reference.

This application also relates to application Ser. No. 09/781,779, is now abandoned titled "Spiral Sheet Antenna Structure and Method" by Eli Yablonovitch et al., owned by the assignee of this application and incorporated herein by reference.

This application also relates to application Ser. No. 10/076,922 filed Feb. 14, 2002, now U.S. Pat. No. 6,906,667 titled "Multifrequency Magnetic Dipole Antenna Structures for Very Low Profile Antenna Applications" by Gregory Poilasne et al., owned by the assignee of this application and incorporated herein by reference.

FIELD OF THE INVENTION

The present invention relates generally to the field of wireless communications, and particularly to the design of an antenna.

BACKGROUND OF THE INVENTION

An antenna is an electrical conductor or array of conductors that radiates (transmits and/or receives) electromagnetic waves. Electromagnetic waves are often referred to as radio waves. Most antennas are resonant devices, which operate efficiently over a relatively narrow frequency band. An antenna must be tuned to the same frequency band that the radio system operates in, otherwise reception and/or transmission will be impaired. Small antennas are required for portable wireless communications. With classical antenna structures, a certain physical volume is required to produce a resonant antenna structure at a particular radio frequency and with a particular bandwidth. Thus, traditionally bandwidth and frequency requirements dictated the volume of an antenna.

The bandwidth of an antenna refers to the range of frequencies over which the antenna can operate satisfactorily. It is usually defined by impedance mismatch but it can also be defined by pattern features such as gain, beamwidth, etc. Antenna designers quickly assess the feasibility of an antenna requirement by expressing the required bandwidth as a percentage of the center frequency of the band. Different types of antennas have different bandwidth limitations. Normally, a fairly large volume is required if a large bandwidth is desired. Accordingly, the present invention addresses the needs of small compact antenna with wide bandwidth. The present invention provides a versatile antenna design that resonates at more than one frequency, that is it is multiresonant, and that may be adapted to a variety of packaging configurations.

A magnetic dipole antenna is a loop antenna that radiates electromagnetic waves in response to current circulating through the loop. The antenna contains one or more elements. Elements are the conductive parts of an antenna system that determine the antenna's electromagnetic characteristics. The element of an magnetic dipole antenna is designed so that it resonates at a predetermined frequency as required by the application for which it is being used. The antenna's resonant frequency is dependant on the capactive and inductive properties of the antenna elements. The capacitive and inductive properties of the antenna elements are dictated by the dimensions of the antenna elements and their interelations.

The radiated electromagnetic wave from an antenna is characterized by the complex vector E×H in which E is the electric field and H is the magnetic field. Polarization describes the orientation of the radiated wave's electric field. For maximum performance, polarization must be matched to the orientation of the radiated field to receive the maximum field intensity of the electromagnetic wave. If it is not oriented properly, a portion of the signal is lost, known as polarization loss. Dependent on the antenna type, it is possible to radiate linear, elliptical, and circular signals. In linear polarization the electric field vector lies on a straight line that is either vertical (vertical polarization), horizontal (horizontal polarization) or on a 45 degree angle (slant polarization). If the radiating elements are dipoles, the polarization simply refers to how the elements are oriented or positioned. If the radiating elements are vertical, then the antenna has vertical polarization and if horizontal, it has horizontal polarization. In circular polarization two orthogonal linearly polarized waves of equal amplitude and 90 degrees out of phase are radiated simultaneously.

Magnetic dipole antennas can be designed with more than one antenna element. It is often desirable for an antenna to resonate at more than one frequency. For each desired frequency, an antenna element will be required. Different successive resonances occur at the frequencies $f_1$, $f_2$, $f_i$ . . . $f_n$. These peaks correspond to the different electromagnetic modes excited inside the structure. The antenna can be designed so that the frequencies provide the antenna with a wide bandwidth of coverage by utilizing overlapping or nearly overlapping frequencies. However, antennas that have an wider bandwidth than a monoresonant antenna often have a correspondingly increased size. Thus, there is a need in the art for a multiresonant antenna; wherein the individual antenna elements share volume within the antenna structure.

SUMMARY OF THE INVENTION

The present invention relates to antennas having small volumes in comparison to prior art antennas of a similar bandwidth and type. In the present invention, the antenna elements include both capacitive and inductive parts. Each element provides a frequency or band of frequencies to the antenna.

In a preferred embodiment, the basic antenna element comprises a substantially planar structure with a planar conductor and a pair of parallel elongated conductors, each having a first end electrically connected to the planar conductor. Additional elements may be coupled to the basic element in an array. In this way, individual antenna structures share common elements and volumes, thereby increasing the ratio of relative bandwidth to volume.

BRIEF DESCRIPTION OF THE DRAWINGS

FIG. 5 illustrates a basic radiating structure utilized in an embodiment of the present invention.

FIG. 6 illustrates a dual-mode antenna in accordance with an embodiment of the present invention.

FIG. 7 illustrates a multimode antenna in accordance with another embodiment of the present invention.

FIG. 8 illustrates an antenna in accordance with the present invention that is formed flat on a substrate.

FIG. 9 illustrates an antenna in accordance with an embodiment of the present invention with returns for ground and a feed.

FIGS. 10A-10C illustrate the use of vias to provide feeds and shorts for an antenna in accordance with an embodiment of the present invention.

FIGS. 11A-11C illustrate a dual frequency antenna in accordance with an embodiment of the present invention with side-by-side elements.

FIG. 12 illustrates a dual frequency antenna in accordance with an embodiment of the present invention with nested elements.

FIG. 13 illustrates an antenna in accordance with an embodiment of the present invention similar to that of FIG. 12 with an additional capacitive element to provide an additional resonant frequency.

FIGS. 14A-14B illustrate a two-sided antenna in accordance with an embodiment of the present invention with three frequencies on one face of a substrate and a single frequency on the other face.

FIGS. 15A-15B illustrate an antenna in accordance with an embodiment of the present invention with conductors formed on the edge as well as the face of a substrate.

FIGS. 16A-16B illustrate a multifrequency planar antenna in accordance with an embodiment of the present invention on a primary substrate with an additional radiating element on a perpendicular secondary substrate.

FIGS. 17A-17B illustrate antennas in accordance with an embodiment of the present invention with multiple secondary substrates.

FIG. 18 illustrates an antenna in accordance with an embodiment of the present invention with an extended radiating element.

FIG. 19 illustrates an antenna in accordance with an embodiment of the present invention with a pair of extended radiating elements.

FIG. 20 shows the antenna of FIG. 19 within an enclosure in accordance with an embodiment of the present invention.

FIG. 21 illustrates an antenna similar to that of FIG. 19 with additional radiating elements on perpendicular secondary substrates in accordance with an embodiment of the present invention.

FIG. 22 shows the antenna of FIG. 21 within an enclosure in accordance with an embodiment of the present invention.

FIG. 23 illustrates an antenna structure in accordance with an embodiment of the present invention with two radiating elements at opposite ends of a substrate.

FIG. 24 illustrates a laptop computer in accordance with an embodiment of the present invention with multiple radiating elements.

FIG. 25 illustrates an antenna in accordance with an embodiment of the present invention printed on a substrate with a milled groove between the conductors.

FIG. 26 illustrates a multifrequency antenna in accordance with an embodiment of the present invention with a plurality of milled grooves.

DETAILED DESCRIPTION OF THE INVENTION

Figure 1:
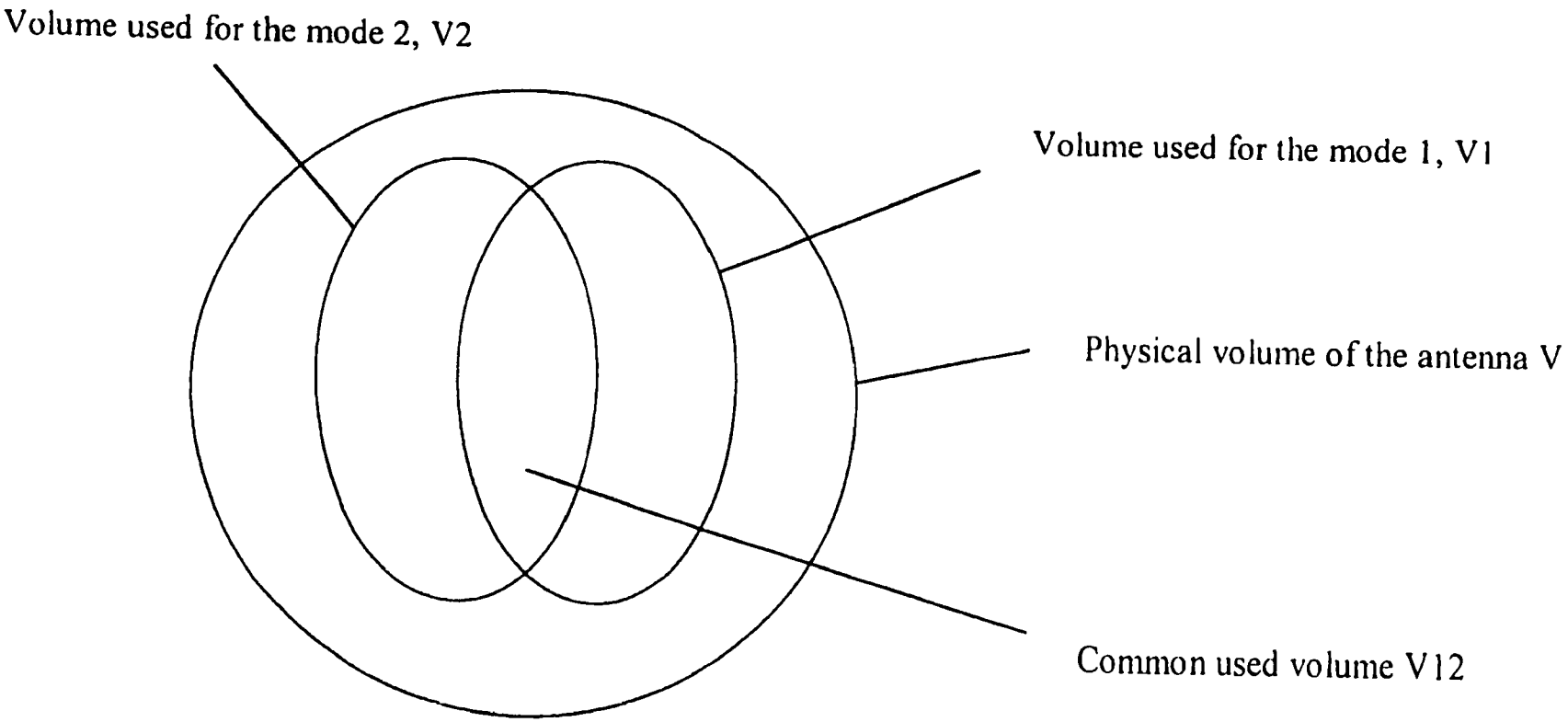
FIG. 1 conceptually illustrates the antenna designs of the present invention.

The volume to bandwidth ratio is one of the most important constraints in modern antenna design. The physical volume of an antenna can place severe constraints on the design of small electronic devices. One approach to increasing this ratio is to re-use the volume for different modes. Some designs already use this approach, even though the designs do not optimize the volume to bandwidth ratio. In these designs, two modes are generated using the same physical structure, although the modes do not use exactly the same volume. The current repartition of the two modes is different, but both modes nevertheless use a common portion of the total available volume of the antenna. This concept of utilizing the physical volume of the antenna for a plurality of antenna modes is illustrated generally by the Venn Diagram of FIG. 1. The physical volume of the antenna ("V") has two radiating modes. The physical volume associated with the first mode is designated '$V_1$', whereas that associated with the second mode is designated '$V_2$'. It can be seen that a portion of the physical volume, designated '$V_{1,2}$', is common to both of the modes.

The concept of volume reuse and its frequency dependence are expressed with reference to "K law". The general K law is defined by the following:

$$\Delta f/f = K \cdot V/\lambda^3$$

wherein $\Delta f/f$ is the normalized frequency bandwidth, $\lambda$ is the wavelength, and the term V represents the physical volume that will enclose the antenna. This volume so far has not been optimized and no discussion has been made on the real definition of this volume and the relation to the K factor.

In order to have a better understanding of the K law, different K factors are defined:

$K_{modal}$ is defined by the mode volume $V_i$ and the corresponding mode bandwidth:

$$\Delta f_i/f_i = K_{modal} \cdot V_i/\lambda_i^3$$

where i is the mode index.

$K_{modal}$ is thus a constant related to the volume occupied by one electromagnetic mode.

$K_{effective}$ is defined by the union of the mode volumes $V_1 \cup V_2 \cup \ldots V_i$ and the cumulative bandwidth. It can be thought of as a cumulative K:

$$\Sigma_i \Delta f_i/f_i = K_{effective} \cdot (V_i \cup V_2 \cup \ldots V_i)/\lambda_C^3$$

where $\lambda$ is the wavelength of the central frequency.

$K_{effective}$ is a constant related to the minimum volume occupied by the different excited modes taking into account the fact that the modes share a part of the volume. The different frequencies fi must be very close in order to have nearly overlapping bandwidths.

$K_{physical}$ or $K_{observed}$ is defined by the physical volume 'V' of the antenna and the overall antenna bandwidth:

$$\Delta f/f = K_{physical} \cdot V/\lambda^3$$

$K_{physical}$ or $K_{observed}$ is the most important K factor since it takes into account the real physical parameters and the usable bandwidth. $K_{physical}$ is also referred to as $K_{observed}$ since it is the only K factor that can be calculated experimentally. In order to have the modes confined within the physical volume of the antenna, $K_{physical}$ must be lower than $K_{effective}$. However these K factors are often nearly equal. The best and ideal case is obtained when $K_{physical}$ is approximately equal to $K_{effective}$ and is also approximately equal to the smallest $K_{modal}$. It should be noted that confining the modes inside the antenna is important in order to have a well-isolated antenna.

One of the conclusions from the above calculations is that it is important to have the modes share as much volume as possible in order to have the different modes enclosed in the smallest volume possible. As previously discussed, the concept is illustrated in the Venn Diagram shown in FIG. 1. Maximizing the number of modes while minimizing the volume of the antenna results in antennas that are multi-resonant, yet are not much larger than a monoresonant antenna.

Figure 2:
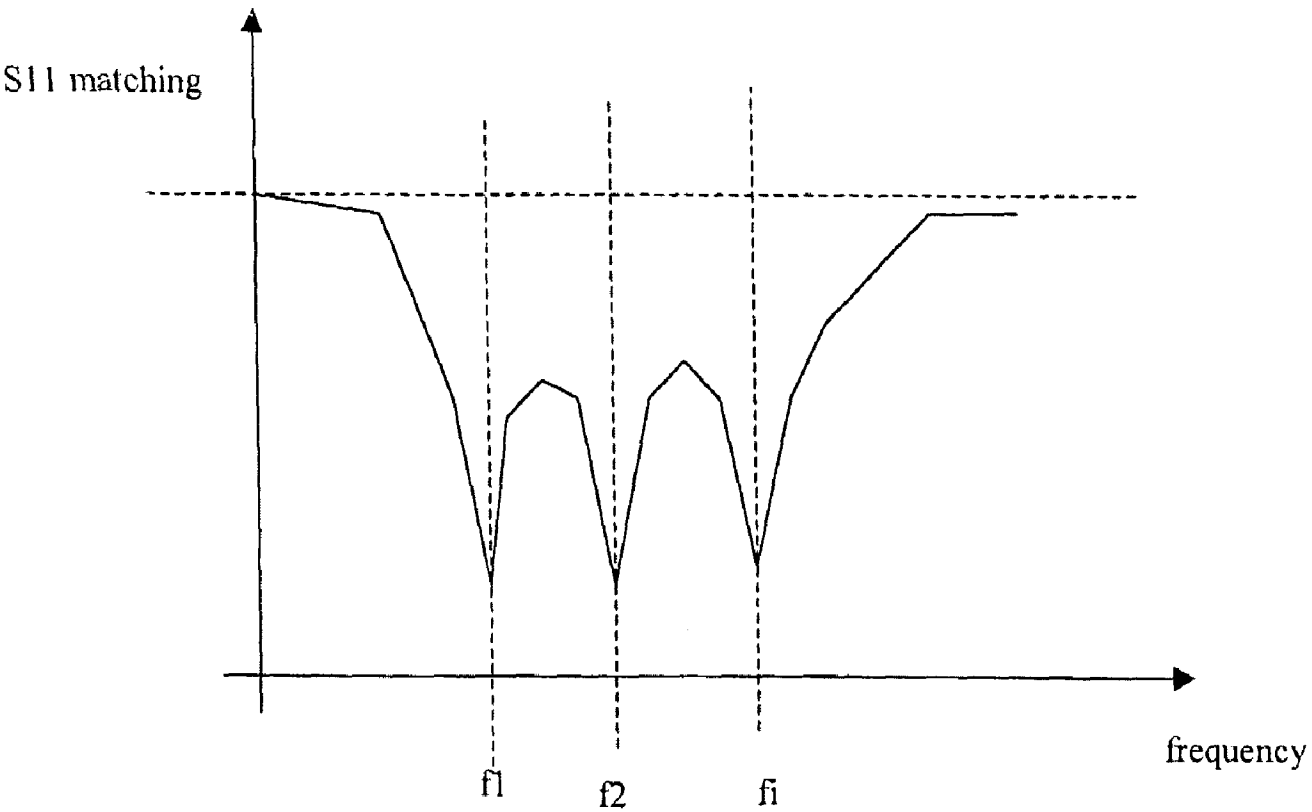
FIG. 2 illustrates the increased overall bandwidth achieved with a multiresonant antenna design.

For a plurality of radiating modes i, FIG. 2 shows the observed return loss of a multiresonant structure. Different successive resonances occur at the frequencies $f_1$, $f_2$, $f_i$ . . . $f_n$. These peaks correspond to the different electromagnetic modes excited inside the structure. FIG. 2 illustrates the relationship between the physical, or observed, K and the bandwidth over $f_1$ to $f_n$.

Figure 3:
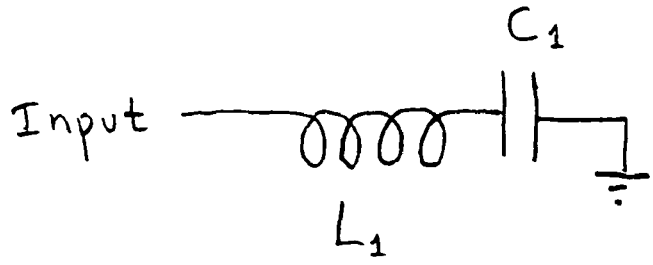
FIG. 3 is an equivalent circuit for a radiating structure.

For a particular radiating mode with a resonant frequency at $f_1$, we can consider the equivalent simplified circuit $L_1C_1$ shown in FIG. 3. By neglecting the resistance in the equivalent circuit, the bandwidth of the antenna is simply a function of the radiation resistance. The circuit of FIG. 3 can be repeated to produce an equivalent circuit for a plurality of resonant frequencies.

Figure 4:
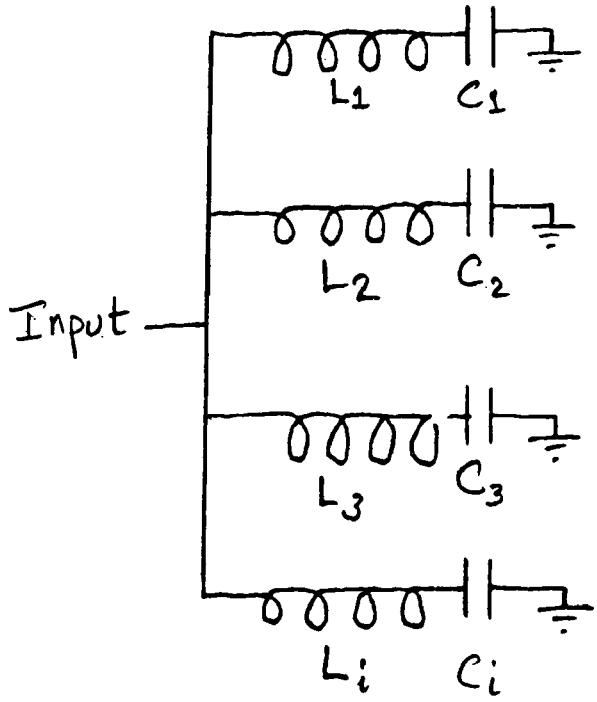
FIG. 4 is an equivalent circuit for a multiresonant antenna structure.

FIG. 4 illustrates a multimode antenna represented by a plurality of inductance(L)/capacitance(C) circuits. At the frequency $f_1$ only the circuit $L_1C_1$ is resonating. Physically, one part of the antenna structure resonates at each frequency within the covered spectrum. By utilizing antenna elements with overlapping resonance frequencies of $f_1$ to $f_n$, an antenna in accordance with the present invention can cover frequencies 1 to n. Again, neglecting real resistance of the structure, the bandwidth of each mode is a function of the radiation resistance.

As discussed above, in order to optimize the K factor, the antenna volume is reused for the different resonant modes. One embodiment of the present invention utilizes a capacitively loaded microstrip type of antenna as the basic radiating structure. Modifications of this basic structure will be subsequently described. In a highly preferred embodiment, the elements of the multimode antenna structures have closely spaced resonance frequencies.

FIG. 5 illustrates a single-mode capacitively loaded antenna. If we assume that the structure in FIG. 5 can be modeled as a $L_1C_1$ circuit, then $C_1$ is the capacitance across gap g. Inductance $L_1$ is mainly contributed by the loop designated by the numeral 2. The gap g is much smaller than the overall thickness of the antenna. The presence of only one LC circuit limits this antenna design to operating at a single frequency.

FIG. 6 illustrates a dual-mode antenna based on the same principles as the antenna shown in FIG. 5. Here, a second antenna element is placed inside the first antenna element described above. This allows tuning one to a certain frequency $f_1$ and the other one to another frequency $f_2$. The two antennas have a common ground, but different capacitive and inductive elements.

FIG. 7 illustrates a multimode antenna with shared inductances $L_1$ and $L_2$ and discrete capacitances $C_1$, $C_2$, and $C_3$. The antenna comprises several antenna elements.

One embodiment of the present invention relates to an antenna with the radiating elements and the conductor lying in substantially the same plane. The radiating elements and the planar element have a thickness that is much less then either their length or width; thus they are essentially two dimensional in nature. Preferably the antenna structure is affixed to a substrate. FIG. 8 illustrates an antenna 10 in accordance with the principles of the present invention that is formed flat on a substrate 12. The antenna is substantially two-dimensional in nature. The antenna comprises a planar conductor 14, a first parallel elongated conductor 16, and a second parallel elongated conductor 18. The planar conductor is positioned in the same plane as the electric field, known as the E-plane. The E-plane of a linearly polarized antenna contains the electric field vector of the antenna and the direction of maximum radiation. The E-plane is orthogonal to the H-plane, i.e. the plane containing the magnetic field. For a linearly polarized antenna, the H-plane contains the magnetic field vector and the direction of maximum radiation. Each of elongated conductors 16 and 18 are electrically connected to the planar conductor 14 by respective connecting conductors 20 and 22. Antenna 10 comprises elongated conductors 16 and 18 that are in the same or substantially the same plane as the planar conductor 14. The gap between the elongated conductor 16 and the elongated conductor 18 is the region of capacitance. The gap between the elongated conductor 16 and the planar conductor 14 is the region of inductance. In a preferred embodiment, the space between the first elongated conductor 16 and the second elongated conductor 18 is much less than the space between the first elongated conductor 16 and the planar conductor 14.

In an alternative embodiment, shown in FIG. 9, the radiating element and the conductor may be isolated. In FIG. 9, a grounded planar conductor 32 is isolated from a radiating element 30 by an etched area 34. An antenna feed 36 is supplied and a return for the ground 38 is supplied. The antenna feeds 36, or feed lines, are transmission lines of assorted types that are used to route RF power from a transmitter to an antenna, or from an antenna to a receiver. In accordance with the principles of the present invention any of the antenna structures discussed herein could utilize an etched area or other means to isolate the radiating element or elements.

Another embodiment of the present invention relates to the use of the antenna structure previously described having an essentially two-dimensional structure, in combination with another planar conductor. The second planar conductor may be located on a opposite face of the substrate. Preferably, the two planar conductors are substantially parallel to eachother. FIGS. 10A-10C show an antenna 40 with planar conductors 44 and 46 on opposite sides of the substrate 42. Vias 50 and 52 provide the antenna feed and shorts to ground, respectively. The vias 50 and 52 connect the radiating elements to the planar conductor 46.

In another embodiment, the antenna structure may utilize more than one radiating element. The radiating elements may be arranged side-by-side as showing in FIGS. 11A-11C. FIGS. 11A-11C show a dual frequency antenna structure, similar to the single element structure of FIGS. 10A-10C The antenna structure has radiating elements 60 and 62 arranged side-by-side. Each radiating element has vias connecting the radiating element to the planar conductor on the opposite face of the substrate. The planar conductors are substantially parallel to eachother.

Alternatively, the radiating structures may be placed in a nested configuration as shown in FIG. 12. FIG. 12 shows another dual frequency arrangement implementing the design of FIG. 6 on a substrate in a manner similar to FIG.

8. In yet another embodiment of the present invention, the antenna structure may utilize three or more radiating elements. The radiating elements may all be located on the same face as the planar conductor. FIG. 13 shows an antenna structure similar to that of FIG. 12, but with an additional conductor 70 to increase the frequency diversity.

FIGS. 14A-14B show an antenna structure on a substrate 80. Face A of substrate 80 carries a three frequency antenna structure as shown in FIG. 13. Face B of substrate 80 carries a single frequency antenna structure as shown in FIG. 8, although alternatively this could also be a multifrequency structure or any combination of single and multifrequency structures.

In an another embodiment, the antenna structure may comprise conductors on any of the faces of the substrate. The conductors may be located in parallel and opposite arrangements or asymmetrically. FIGS. 15A-15B show an antenna structure 90 with conductors formed, such as by conventional printed circuit methods, on the edges as well as the face surface of the substrate 92. This allows even more space savings in certain packaging configurations.

In yet another embodiment, more than one substrate may be used. As shown in FIGS. 16A-16B, an second substrate bearing additional conductors can be utilized. The second substrate may be located perpendicular to the first substrate. As shown in FIGS. 16A-16B, a primary substrate 100 carries a multifrequency antenna structure, such as the one shown in FIG. 13. A secondary substrate 102 is mounted substantially perpendicular to the primary substrate. The substrate 102 carries a single frequency antenna structure, although alternatively this too could be a multifrequency structure.

In addition, in accordance with the principles of the present invention more than one secondary substrate may be utilized. FIGS. 17A-17B show additional arrangements, similar to FIGS. 16A-16B, wherein a plurality of secondary substrates, each carrying respective antenna structures, are mounted on a primary substrate.

Furthermore, the secondary substrate may be arranged in any configuration, not only in perpendicular positions. FIG. 18 illustrates an antenna 110 on a substrate 112 that is extended relative to substrate 114. This allows installation of the antenna in an enclosure with a shape that just allows an antenna along the side of the enclosure.

FIG. 19 illustrates a configuration similar to that of FIG. 18, but with two antennas for frequency diversity.

An antenna structure in accordance with the principles of the present invention may be integrated into an electronic device. The previously discussed benefits of the present invention make such an antenna structure well suited to use in small electronic devices, for example, but not limited to mobile telephones. FIG. 20 shows the antenna structure of FIG. 19 housed within an enclosure, such as the case of a mobile telephone or other electronic device.

FIG. 21 illustrates a configuration similar to that of FIG. 19, but with four radiating elements, including elements carried on secondary substrates 120 and 122.

FIG. 22 shows the antenna structure of FIG. 21 housed within an enclosure, such as the case of a mobile telephone or other electronic device. The low profile of the antenna of the present invention allows for the antenna to be placed easily within electronic devices without requiring a specifically dedicated volume.

FIG. 23 illustrates a circuit board 130 with radiating elements 132 and 134 disposed at opposite ends thereof. Similarly, in FIG. 24, an electronic device, such as a laptop computer 140, is configured with a plurality of radiating elements. Owing to their construction, the radiating elements may be arranged within the computer wherever space is available. Thus, the design of the computer housing need not be dictated by the antenna requirements.

In yet another alternative embodiment, the antenna structure may comprise grooves. The grooves may be partially or completely through the substrate in various locations, such as between the radiating elements. FIG. 25 illustrates an antenna of the type generally shown in FIG. 9. The antenna is formed, such as by conventional printed circuit techniques, on a substrate 150. A groove 152 is milled partially or completely through the substrate in the capacitive region of the antenna to improve the efficiency of the antenna.

FIG. 26 illustrates the same concept shown in FIG. 25, but in the case of a multifrequency antenna. Here, a plurality of grooves 162 are milled into substrate 160 between each pair of radiating conductors.

Accordingly, while embodiments and implementations of the invention have been shown and described, it should be apparent that many more embodiments and implementations are within the scope of the invention. Therefore, the invention is not to be restricted, except in light of the claims and their equivalents.

What is claimed is:

1. An antenna comprising:

a first planar conductor;

a first elongated conductor and a second elongated conductor, which are each substantially coplanar with the planar conductor;

the first elongated conductor having a first end electrically connected to the first planar conductor and a second end;

the second elongated conductor, parallel to the first elongated conductor and spaced apart therefrom, having a first end electrically connected to the first planar conductor; and a third elongated conductor spaced apart from the first planar conductor and electrically connected to at least one of the first end of the first elongated conductor and the first end of the second elongated conductor.

2. The antenna of claim 1, wherein the first end of the first elongated conductor is electrically connected to the third elongated conductor by a first connecting conductor perpendicular to the first elongated conductor and the first end of the second elongated conductor is electrically connected to the third elongated conductor by a second connecting conductor perpendicular to the second elongated conductor.

3. The antenna of claim 1, wherein the third elongated conductor is electrically connected to the first planar conductor.

4. The antenna of claim 1, further comprising a substrate and wherein the first planar conductor, the first elongated conductor, and the second elongated conductor are disposed on a first side of the substrate.

5. The antenna of claim 1, further comprising a substrate and wherein the first planar conductor is disposed on a first side of the substrate and the first elongated conductor and the second elongated conductor are disposed on a second side of the substrate.

6. The antenna of claim 5 further comprising a second planar conductor disposed on the second side of the substrate.

7. The antenna of claim 6, wherein the first end of the first elongated conductor and the first end of the second elongated conductor are electrically connected to the first planar conductor by vias through the substrate.

8. An antenna comprising:

a first planar conductor;

a first elongated conductor and a second elongated conductor, which are each substantially coplanar with the planar conductor;

the first elongated conductor having a first end electrically connected to the first planar conductor and a second end; and the second elongated conductor, parallel to the first elongated conductor and spaced apart therefrom, having a first end electrically connected to the first planar conductor, wherein the first elongated conductor and the second elongated conductor comprise a first element and further wherein the antenna comprises a second element in a nested configuration with the first element.

9. The antenna of claim 8, wherein the second element is disposed between the first element and the first planar conductor.

10. An antenna comprising:

a first planar conductor;

a first elongated conductor and a second elongated conductor, which are each substantially coplanar with the planar conductor;

the first elongated conductor having a first end electrically connected to the first planar conductor and a second end; and the second elongated conductor, parallel to the first elongated conductor and spaced apart therefrom, having a first end electrically connected to the first planar conductor, wherein the first elongated conductor and the second elongated conductor comprise a first element and further wherein the antenna comprises a second element, wherein at least one of the first and second elements further comprises a third elongated conductor having a first end electrically connected to the first planar conductor.

11. An antenna comprising:

a first planar conductor;

a first elongated conductor and a second elongated conductor, which are each substantially coplanar with the planar conductor;

the first elongated conductor having a first end electrically connected to the first planar conductor and a second end; and the second elongated conductor, parallel to the first elongated conductor and spaced apart therefrom, having a first end electrically connected to the first planar conductor, wherein the first elongated conductor and the second elongated conductor comprise a first element and further wherein the antenna comprises a second element, the antenna further comprising a substrate and wherein the first element and the second element are disposed adjacent to opposing edges of the substrate.

12. An antenna comprising:

a first planar conductor;

a first elongated conductor and a second elongated conductor, which are each substantially coplanar with the planar conductor;

the first elongated conductor having a first end electrically connected to the first planar conductor and a second end; and the second elongated conductor, parallel to the first elongated conductor and spaced apart therefrom, having a first end electrically connected to the first planar conductor, wherein the first elongated conductor and the second elongated conductor comprise a first element and further wherein the antenna comprises a second element, the antenna further comprising a primary substrate with the first element disposed thereon and a secondary substrate attached to the primary substrate with the second element disposed thereon.

13. The antenna of claim 12 further comprising a plurality of secondary substrates attached to the primary substrate with a corresponding plurality of elements disposed thereon.

14. The antenna of claim 13, wherein each of the plurality of secondary substrates is perpendicular to the primary substrate.

15. An antenna comprising:

a first planar conductor;

a first elongated conductor and a second elongated conductor, which are each substantially coplanar with the planar conductor;

the first elongated conductor having a first end electrically connected to the first planar conductor and a second end;

the second elongated conductor, parallel to the first elongated conductor and spaced apart therefrom, having a first end electrically connected to the first planar conductor;

a primary substrate;

a secondary substrate attached to the primary substrate and perpendicular thereto; and a third parallel elongated conductor and a fourth parallel elongated conductor on the secondary substrate, each having a first end electrically connected to the first planar conductor.

16. The antenna of claim 15 comprising a plurality of secondary substrates attached to the primary substrate and perpendicular thereto, each of the secondary substrates having respectively a third parallel elongated conductor and a fourth parallel elongated conductor thereon.

17. An antenna comprising:

a first planar conductor;

a first elongated conductor and a second elongated conductor, which are each substantially coplanar with the planar conductor;

the first elongated conductor having a first end electrically connected to the first planar conductor and a second end; and the second elongated conductor, parallel to the first elongated conductor and spaced apart therefrom, having a first end electrically connected to the first planar conductor, wherein the first planar conductor, the first elongated conductor, and the second elongated conductors are disposed on a first side of a substrate and further comprising a second planar conductor and a third parallel elongated conductor and a fourth parallel elongated conductor each having a first end electrically connected to the second planar conductor and disposed on a second side of the substrate.

* * * * *